United States Patent [19]

Koyama et al.

[11] Patent Number: 4,551,423

[45] Date of Patent: Nov. 5, 1985

[54] PHOTOGRAPHIC LIGHT-SENSITIVE MATERIAL WITH NUCLEOPHILIC DISPLACEMENT DYE RELEASERS

[75] Inventors: Koichi Koyama; Yasuhiro Noguchi; Masaharu Toriuchi, all of Kanagawa, Japan

[73] Assignee: Fuji Photo Film Co., Ltd., Kanagawa, Japan

[21] Appl. No.: 597,623

[22] Filed: Apr. 6, 1984

[30] Foreign Application Priority Data

Apr. 6, 1983 [JP] Japan ..... 58-60289

[51] Int. Cl.[4] ..... G03C 1/40; G03C 5/54

[52] U.S. Cl. ..... 430/559; 430/203; 430/223; 430/224; 430/542

[58] Field of Search ..... 430/203, 223, 224, 559, 430/542, 543, 558

[56] References Cited

U.S. PATENT DOCUMENTS

| | | | |
|---|---|---|---|
| 4,139,379 | 2/1979 | Chasman et al. | 430/223 |
| 4,139,389 | 2/1979 | Hinshaw et al. | 430/223 |
| 4,199,355 | 4/1980 | Hinshaw et al. | 430/223 |
| 4,263,393 | 4/1981 | Chen | 430/218 |
| 4,381,339 | 4/1983 | Renner et al. | 430/223 |

*Primary Examiner*—Richard L. Schilling

*Attorney, Agent, or Firm*—Sughrue, Mion, Zinn, Macpeak, and Seas

[57] ABSTRACT

A photographic light-sensitive material comprising a support having provided thereon at least one light-sensitive silver halide emulsion layer in combination with an immobile LDA compound represented by the following general formula (I):

(I)

wherein n, x, y and z each stands for an integer of 1 or 2; m stands for an integer of 1 or more; D stands for a group containing an electron donor or its precursor moiety; A stands for an organic group linking Nup to —E—Q—Col or D; Nup stands for a precursor of a nucleophilic group; E stands for an electrophilic center; Q is a divalent group; Col stands for a group containing a dye or its precursor moiety; Ball stands for a ballast group; L stands for a linking group; and M stands for an optional substituent, said LDA compound being capable of releasing a diffusible dye or its precursor upon redox reaction.

17 Claims, No Drawings

PHOTOGRAPHIC LIGHT-SENSITIVE MATERIAL WITH NUCLEOPHILIC DISPLACEMENT DYE RELEASERS

FIELD OF THE INVENTION

This invention relates to a novel photographic light-sensitive material which comprises a redox compound releasing a diffusible dye and more particularly, to a color photographic light-sensitive material which comprises a redox compound releasing a diffusible or a precursor thereof upon a redox reaction subsequently occurred after the development of the light-sensitive material.

BACKGROUND OF THE INVENTION

In the color diffusion transfer photography, it is well known to use a redox compound releasing a diffusible dye as a dye image-forming compound (a coloring material). Such redox compound includes so-called negative and positive type coloring materials. When a positive transfer image is obtained with the negative type coloring material, a positive emulsion is used or other reversing mechanism is needed. On the other hand, when a positive transfer image is obtained with the positive type coloring material, a negative emulsion can be used. Thus, the positive type coloring material is variously advantageous, for example, in that it can provide a light-sensitivity material having high sensitivity.

As such positive type coloring materials, there can be exemplified immobile compounds as disclosed in Patent Application (OPI) Nos. 111628/74 and 4819/77 to Hinshaw and 63618/76 to Fields (the term "OPI" as used herein refers to a "published unexamined Japanese patent application"). These immobile compounds can release diffusible dyes upon an intermolecular nucleophilic reaction in the reduced state in the presence of an alkali. On the other hand, when they are oxidized in the light-sensitive material by a redox reaction, the rate of releasing the dyes decreases. Such a property of these immobile compounds can be utilized to imagewise form a positive transfer image. However, these immobile compounds leave much to be desired. For example, since oxidation and alkaline hydrolysis compete with each other in these immobile compounds, a possible mistiming of the both reactions or the like causes fog and deteriorates discrimination. Furthermore, since the released dyes have no water-soluble groups, they are poor in diffusability, and even once diffused into a mordant layer, the released dyes (image-forming dyes) are hard to fix (i.e., easy to leave) before mordanting.

As the positive type coloring material which solves the above disadvantages, a "BEND compound" is disclosed in U.S. Pat. No. 4,139,379.

This compound can eliminate the above disadvantages, including the deterioration of discrimination, because its nucleophilic groups become precursors requiring the acceptance of one electron before an intermolecular nucleophilic displacement.

Specifically, the BEND compound becomes useful only when it is combined with an electron donor (reducing agent) which can reduce it into a state such that the intermolecular nucleophilic displacement takes place. Accordingly, the BEND compound is disadvantageous in that the release of the dyes is delayed in proportion to its reaction with the reducing agent.

SUMMARY OF THE INVENTION

It is an object of the invention to provide a photographic light-sensitive material which contains a positive type coloring material having a high rate of releasing dyes.

It is another object of the invention to provide a color diffusion transfer photographic light-sensitive material containing such a positive type coloring material.

It is still another object of the invention to provide a heat-developable color photographic light-sensitive material.

These objects have been effectively achieved by the use, in a photographic light-sensitive material having at least one light-sensitive layer on a support, of LDA (Linked-Donor Acceptor) of the general formula (I) below which releases a diffusible dye or a precursor thereof as a result of the redox reaction in combination with the light-sensitive layer.

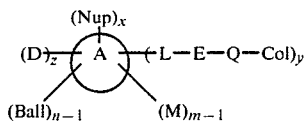

(I)

wherein n, x, y and z each stands for an integer of 1 or 2; m stands for an integer of 1 or more; D stands for a group containing an electron donor or its precursor moiety; A stands for an organic group linking Nup to -E-Q-Col or D; Nup stands for a precursor of a nucleophilic group; E stands for an electrophilic center; Q stands for a divalent group such as an imino group (including a substituted imino group) or an oxygen or sulfur atom; Col stands for a group containing a dye or its precursor moiety; Ball stands for a ballast group; L stands for a linking group; and M stands for an optional substituent.

Namely, this LDA compound features that an electron donor (reducing agent) or precursor thereof is incorporated in a redox compound (positive type coloring material) to provide an integrated body.

Specifically, the LDA compound of this invention has high stability to oxidation in the light-sensitive material during preservation, excellent transfer property, and high efficiency of release of dyes and releases less dyes upon the reduction of the developer. (Such a release of dyes causes fog.) Thus, the LDA compound has a remarkable effect such that a transfer image having a high image quality (low Dmin and high Dmax) can be obtained within a short period of time.

DETAILED DESCRIPTION OF THE INVENTION

Referring more specifically to each group in the above general formula (I), the precursor of electron donor represented by D means one which becomes an electron donor (reducing agent) under alkaline conditions. As the organic group represented by A, there can be used a group derived from aromatic hydrocarbon rings or heterocyclic compounds or an organic group having other conjugated double bonds (e.g., a group derived from hydrocarbons having conjugated double bonds such as ethylene and butadiene). The nucleophilic precursor represented by Nup means one which becomes a nucleophilic group when reduced by the electron donor incorporated in the LDA compound and specifically, precursors of hydroxyamino groups such as nitroso and nitro groups, precursors of hydroxyl groups such as oxo group, precursors of amino groups such as imino and alkylimino groups, and precursors of sulfonamido groups such as sulfonimido group can be used. As E, there can be used thiocarbonyl or sulfonyl group, and preferably carbonyl group. As the substituent represented by M, there can be used an electron attractive group such as sulfo group.

The dye or its precursor moiety represented by Col means an existing dye moiety or dye precursor moiety which can be converted to a dye at the photographic treatment step or additional treatment steps. The final image dye may or may not be complexed with metals. As the final image dye, there can be used azo dyes, azomethine dyes, anthraquinone dyes and phthalocyanine dyes which are or not complexed with metals. Particularly important among these dyes are cyan, magenta and yellow dyes.

Col includes groups having, for example, an —$SO_2NH$— aromatic divalent group (e.g., phenylene group) bonded to the dye or its precursor moiety.

As the yellow dye, there can be used yellow dyes as disclosed in U.S. Pat. Nos. 3,597,200, 3,309,199, 4,013,633, 4,245,028, 4,156,609, 4,139,383, 4,195,992, 4,148,641 and 4,148,643; Japanese Patent Application (OPI) Nos. 114930/76, 16130/80 and 71072/81; and *Research Disclosure,* 17630 (1978) and ibid., 16475 (1977).

As the magenta dye, there can be used magenta dyes as disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; and Japanese Patent Application (OPI) Nos. 106727/77, 106727/77, 23628/78, 36804/80, 73057/81, 71060/81 and 134/80.

As the cyan dye, there can be used cyan dyes as disclosed in U.S. Pat. Nos. 3,482,972, 3,929,760, 4,013,635, 4,268,625, 4,171,220, 4,242,435, 4,142,891, 4,195,994, 4,147,544 and 4,148,642; British Pat. No. 1,551,138; Japanese Patent Application (OPI) Nos. 99431/79, 8827/77, 47823/78, 143323/78, 99431/79 and 71061/81; European Patent (EPC) Nos. 53,027 and 53,040; and *Research Disclosure,* 17630 (1978), ibid., 16475 (1975) and ibid., 16475 (1977).

As the dye precursor moiety, there can be used an LDA compound having a dye moiety whose light absorption is shifted for a while in the light-sensitive elements. Examples of such LDA compound are those described in U.S. Pat. Nos. 4,310,612, 3,336,287, 3,579,334 and 3,982,946; U.S. Defensive Publication No. T-999,003; British Pat. No. 1,467,317; and Japanese Patent Application (OPI) No. 158638/82.

Ball stands for a ballast group. The ballast group is no longer restricted if it is large enough to immobilize the LDA compound. The ballast group is a photographically inert group such as a $C_{1-40}$, preferably $C_{6-20}$ alkyl or aryl group.

D stands for a group containing an electron donor or its precursor moiety for donating an electron to the precursor of nucleophilic group. The electron donor or its precursor moiety may be connected to Ⓐ directly or via the linking group.

The electron donor or its precursor moiety is a group derived from compounds described, for example, in U.S. Pat. Nos. 4,218,750 and 4,263,393 and Japanese Patent Application (OPI) No. 138736/81.

Specifically, the precursor moiety of the electron donor is derived, for example, from compounds of the general formula (D-I) described below:

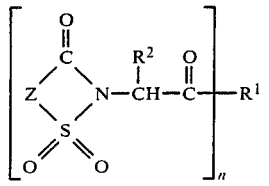

(D-I)

wherein Z stands for an atomic group necessary for the formation of a monocyclic, bicyclic or tricyclic ring (each ring is preferably a 5- or 6-membered ring, and as a fused ring constituting the bicyclic or tricyclic ring, there can be selected an aromatic ring such as benzene or naphthalene ring); n stands for an integer of 1 or 2; $R^1$ stands for a monovalent aromatic ring (e.g., benzene ring) when n is 1 and stands for a divalent aromatic ring when n is 2; and $R^2$ stands for an optional substituent such as hydrogen atom, alkyl group, arly group, acyl group, ester group and amido group.

The "alkyl groups" and "alkyl residues" referred to in this specification include substituted alkyl groups and alicyclic alkyl groups.

Preferable precursor moieties of the electron donors have the structure of the general formula (D-Ia) shown below:

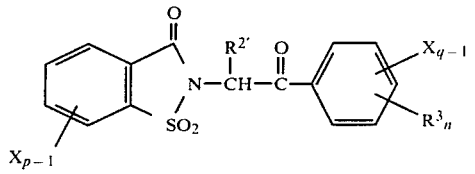

(D-Ia)

wherein $R^{2'}$ stands for a hydrogen atom, a $C_{1-30}$ alkyl group or a $C_{6-30}$ aryl group; X stands for a divalent connecting group such as carbamoyl group, sulfamoyl group, carboxyamido group, sulfonamido group, ether group, thioether group and ester group, singly or in combination (alternatively, two of these groups may be connected to each other via —$CH_2)_m$, in which m is an integer of about 2 to about 6 or may be connected to each other in such a manner as to form a part of the ring (e.g., 5- or 6-membered ring); p and q each stands for an integer of 1 or 2 (when p is 2, then q is 1, whereas when p is 1, then q is 2); $R^3$ stands for an optional substituent such as hydrogen atom, $C_{1-30}$ alkyl group, $C_{1-30}$ alkyloxy group, halogen atom, acylamino group, sulfonamido group, cyano group and acyl group; and n stands for an integer of 1 to 3.

The precursor moiety of the electron donor is also derived from compounds of the general formula (D-II) shown below:

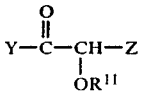

(D-II)

wherein $R^{11}$ stands for a group unstable against alkalis (—OR group decomposes under alkaline conditions to provide —OH group); Y stands for an aliphatic or aromatic group; and Z stands for an electron attractive group.

Preferable precursor moieties of the electron donors of the invention are represented by the general formula (D-IIa) shown below:

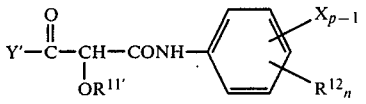

(D-IIa)

wherein $R^{11'}$ stands for group unstable against alkalis, such as acyl groups represented by acetyl and benzoyl groups; Y' stands for a $C_{1-30}$ alkyl group or a phenyl group of the formula:

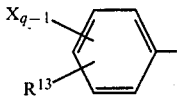

in which X is as defined above; p and q each stands for an integer of 1 or 2 (when p is 2, then q is 1, whereas when p is 1, then q is 2); $R^{12}$ and $R^{13}$ each stands for an optional substituent such as hydrogen atom, $C_{1-30}$ alkyl group, $C_{1-30}$ alkyloxy group, halogen atom, acylamino group, sulfonamido group, cyano group, and acyl group, $R^2$ and $R^3$ being either the same or different from each other; and n stands for an integer of 1 to 3.

Alternatively, the precursor moiety of the electron donor is derived from compounds of the general formula (D-III) shown below:

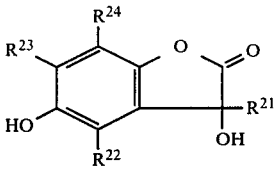

(D-III)

wherein $R^{21}$ stands for an aromatic or heterocyclic group; and $R^{22}$, $R^{23}$ and $R^{24}$, which may be the same or different, each stands for a hydrogen atom, $C_{1-30}$ alkyl group, $C_{1-30}$ alkyloxy group, aryl group or alkylthio group.

Preferable precursor moieties of the electron donors are represented by the general formula (D-IIIa) shown below:

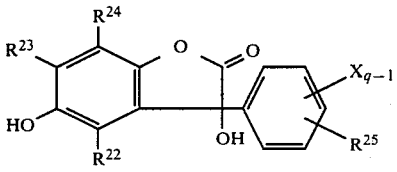

(D-IIIa)

wherein $R^{22}$, $R^{23}$ and $R^{24}$ are as defined above with the proviso that any one of $R^{22}$, $R^{23}$ and $R^{24}$ can be $(R^{26})_{m-1}X$ when q=1, in which m stands for an integer of 1 or 2, and $R^{26}$ stands for a $C_{1-17}$ alkylene or phenylene group; X stands for a divalent connecting group as defined above; and $R^{25}$ stands for an optional substituent such as hydrogen atom, $C_{1-30}$ alkyl group, $C_{1-30}$ alkyloxy group, acylamino group, acyl group, ester group, nitro group, halogen atom and cyano group.

For example, groups derived from hydroquinone and derivatives thereof, aminophenol and derivatives thereof, ascorbic acids, benzisoxazolones and the like are effective as the electron donor moiety.

As examples of the precursor moiety of the electron donor used in the most preferred embodiment of the invention, there can be selected the following groups:

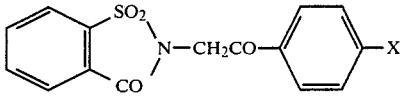

D-1

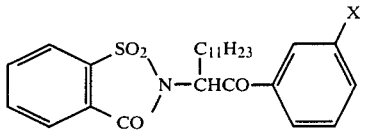

D-2

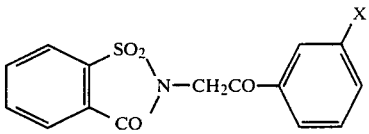

D-3

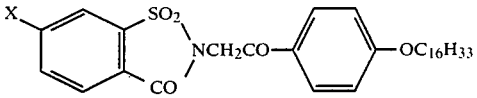

D-4

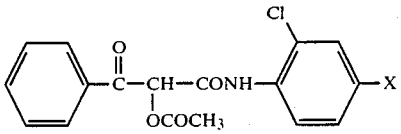

D-5

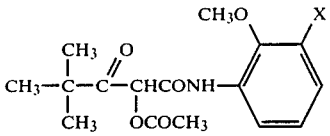

D-6

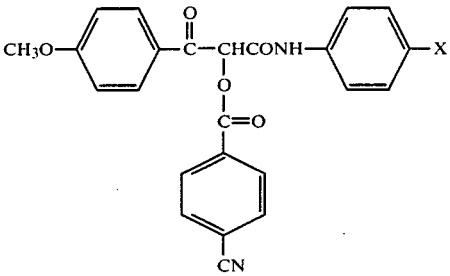

D-7

-continued

D-8

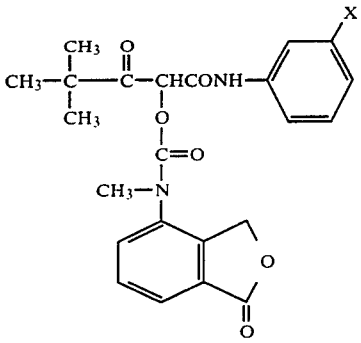

D-9

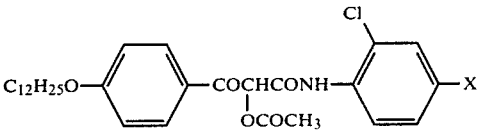

D-10

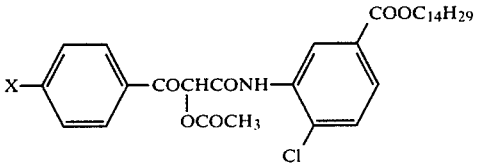

D-11

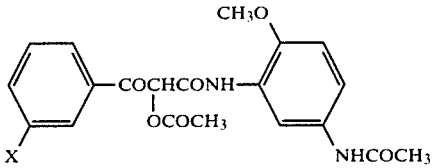

D-12

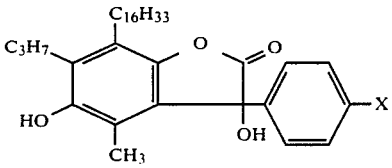

D-13

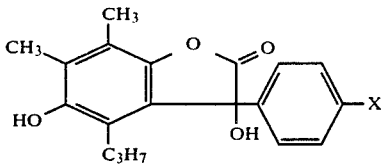

D-14

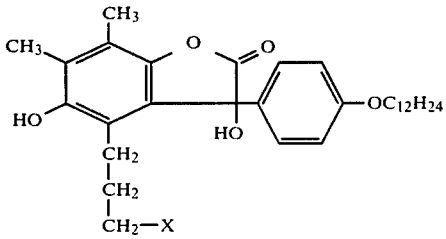

-continued

D-15

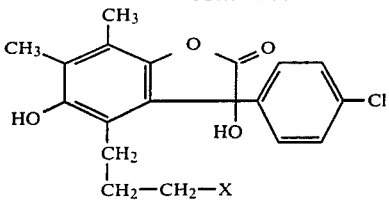

D-16

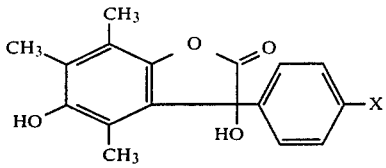

Among the LDA compounds of the invention preferable ones are represented by the general formula (II) shown below:

(II)

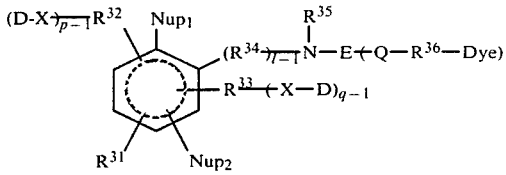

wherein $Nup_1$ and $Nup_2$ each stands for a precursor of hydroxyl group as a nucleophilic group, these nucleophilic groups being the same or different from each other, preferably the same, and more preferably oxo group (the position of $Nup_1$ and $Nup_2$ are in such positions as to orient ortho or para, preferably para, and $Nup_2$ together with $R^-$ or $R^{33}$ may form a ring such as aromatic carbon ring, heterocyclic ring or saturated carbon ring); E stands for an electrophilic center, particularly a carbonyl or thiocarbonyl group, and preferably a carbonyl group; Q stands for a divalent group connecting E and $R^{36}$, particularly an oxygen or sulfur atom, or an imino group (including a substituted imino group such as alkyl or aromatic group-substituted imino group), and preferably a divalent group of an oxygen atom; $R^{34}$ stands for a divalent linking group, e.g., an alkylene group having one to three carbon atoms in its main linking chain which may be substituted, or a divalent group containing at least one methylene group in the main linking chain which is substituted with an alkyl or aryl group, preferably a methylene group or an alkyl or aryl-substituted methylene group; l stands for an integer of 1 or 2, preferably 2; $R^{36}$ stands for an aromatic group having at least 5, preferably 5 to about 20 atoms, including a heterocyclic group containing a nucleus such as pyridine, tetrazole, benzimidazole, benztriazole or isoquinoline, and an arylene group having 6 to about 20 carbon atoms (including substituted arylene group), preferably a phenylene or naphthylene group, or $R^{36}$ may also stand for an aliphatic hydrocarbon group having 1 to about 6 carbon atoms (including a substituted alkylene group); $R^{35}$ stands for an alkyl group having 1 to about 40 carbon atoms or an aryl group having 6 to about 40 carbon atoms (including a substituted aryl group); p and q each stands for an integer of 1 or 2, with proviso that the both do not stand for 1 at the same time and that when p or q is 2, then $R^{32}$ or $R^{33}$, which may be the same or different, stands for an optional substituent such as alkylene or substituted alkylene group having 1 to about 20 carbon atoms and phenylene or substituted phenylene groups having 6 to about 20 carbon atoms, in which when $R^{32}$ or $R^{33}$ stands for an alkylene group, it may have a divalent linking group such as carbamoyl group, sulfamoyl group, carboxyamido group, sulfonamido group, ether group, thioether group and ester group in any position, and $R^{32}$ and $R^{33}$ are preferably alkylene groups having 1 to about 11 carbon atoms, whereas when p or q is 1, $R^{32}$ or $R^{33}$ stands for a hydrogen or halogen atom, an alkyl, alkoxy or alkylthio group having 1 to about 20 carbon atoms, or a phenyl or substituted phenyl group having up to about 20 carbon atoms, in which the above alkyl group, alkoxy group and alkylthio group may have at any position in its alkyl group (residue) a divalent linking group as defined above); Dye stands for a dye or its precursor moiety; -X-D stands for a precursor moiety of electron donor of the general formula (D-Ia), (D-IIa) or (D-IIIa) described hereinbefore, preferably of the general formula (D-Ia) or (D-IIa); and $R^{31}$ stands for a one-atom-substituent such as a hydrogen or halogen atom, preferably a multi-atom-substituent such as an alkyl, alkoxy or alkylthio group having 1 to about 40 carbon atoms or an aryl group having 6 to about 40 carbon atoms, in which $R^{31}$ and $R^{32}$ together may form a ring, and $R^{31}$ may also stand for a group of the general formula:

$$\left(R^{34}\right)_{l-1}\overset{R^{35}}{\overset{|}{N}}-E\left(Q-R^{36}-Dye\right)$$

in which all symbols are as defined above, at least one or a combination of $R^{31}$, $R^{32}$, $R^{33}$, $R^{34}$ and $R^{35}$ optionally forming a ballast group (i.e., a group large enough to substantially immobilize the above LDA compound in an alkali-peameable layer in the photographic light-sensitive material), or such a ballast group optionally being contained in the precursor moiety of electron donor.

Typical LDA compounds used in the invention are shown hereinafter.

LDA-1

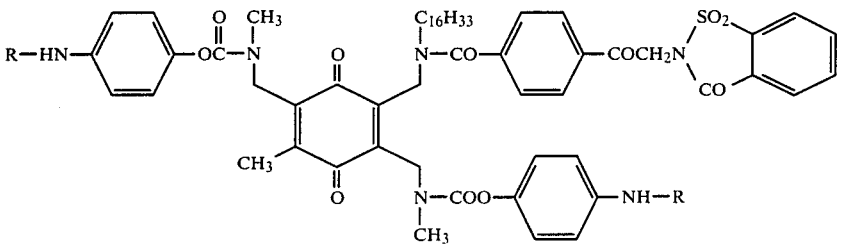

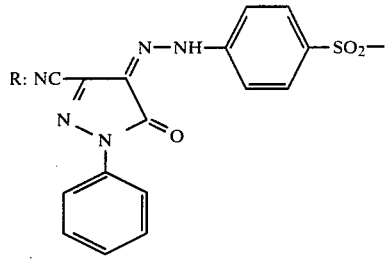

LDA-2

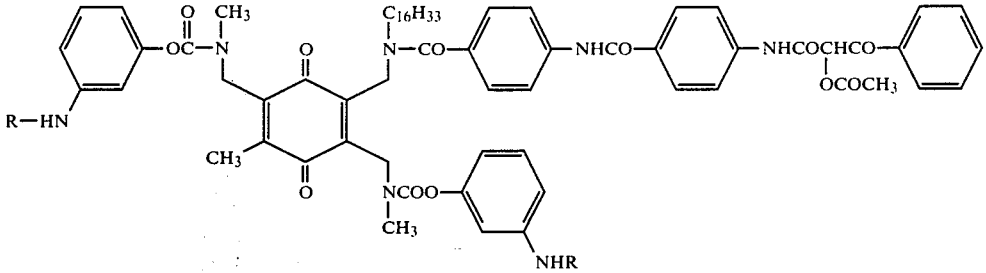

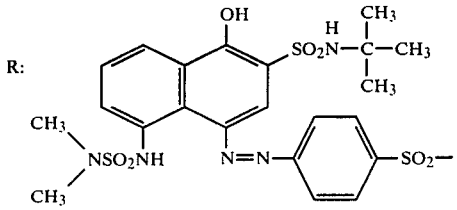

LDA-3

-continued
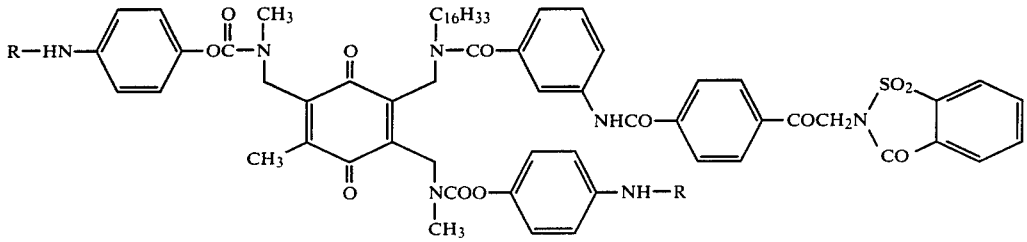
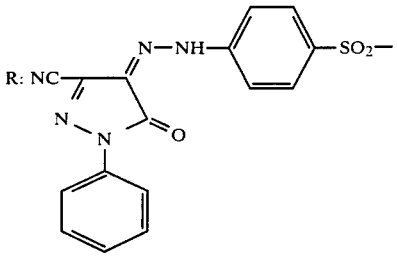
LDA-4
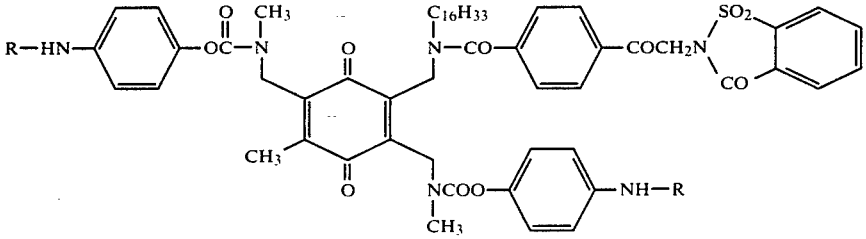
R:
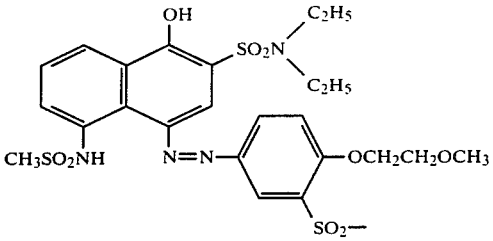
LDA-5
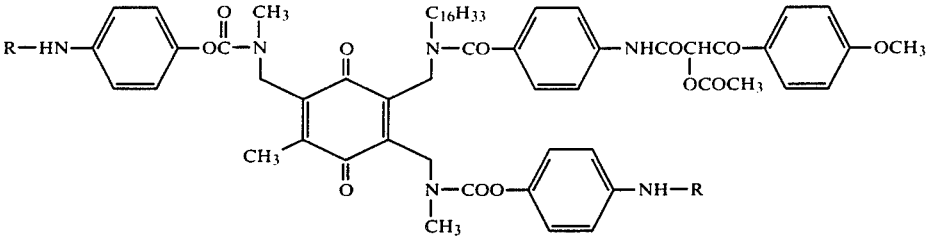
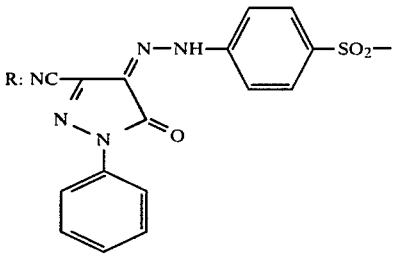
LDA-6

-continued
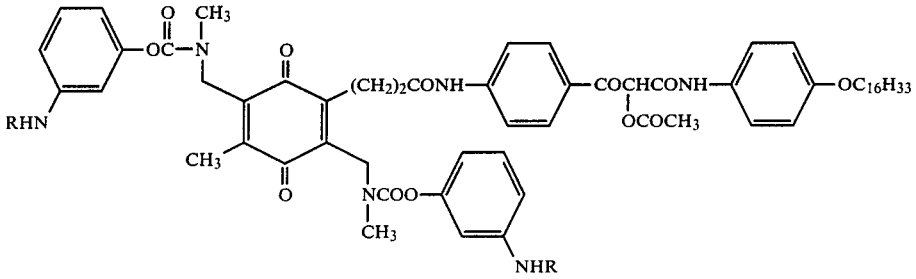
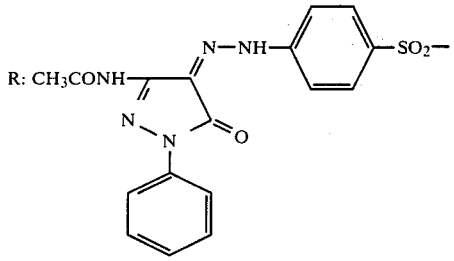
LDA-7
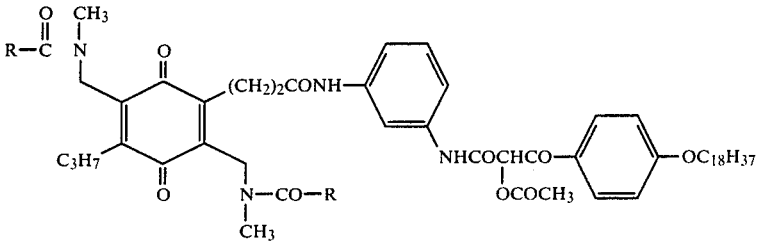
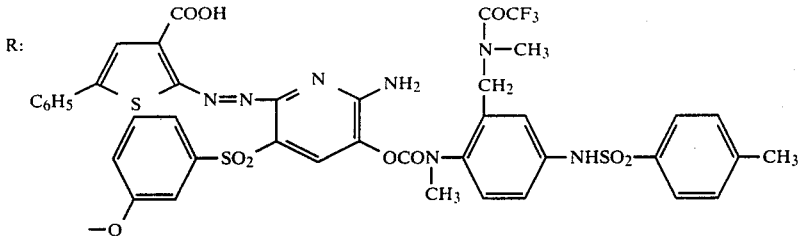
LDA-8
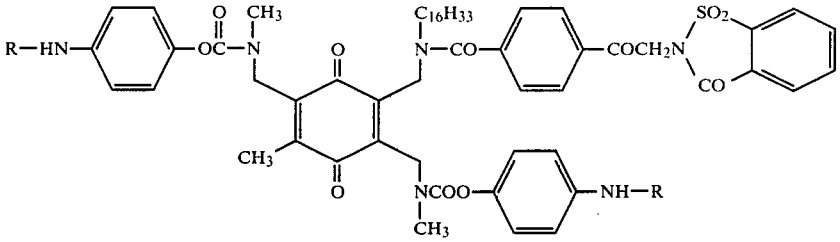
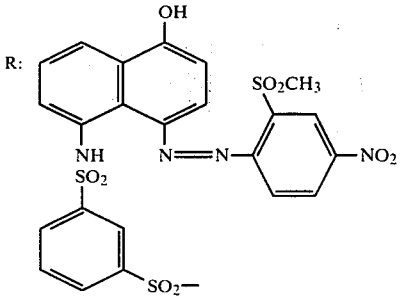

-continued
LDA-9
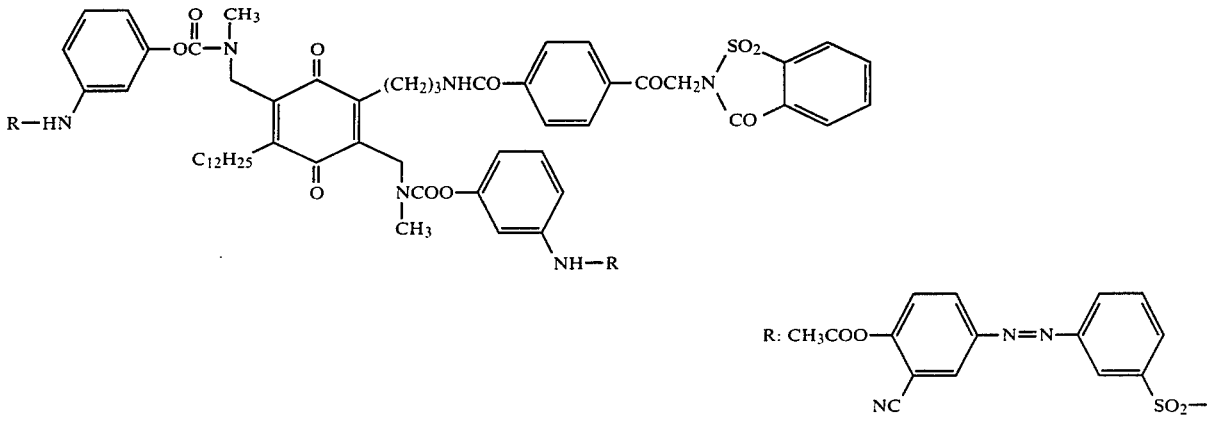
LDA-10
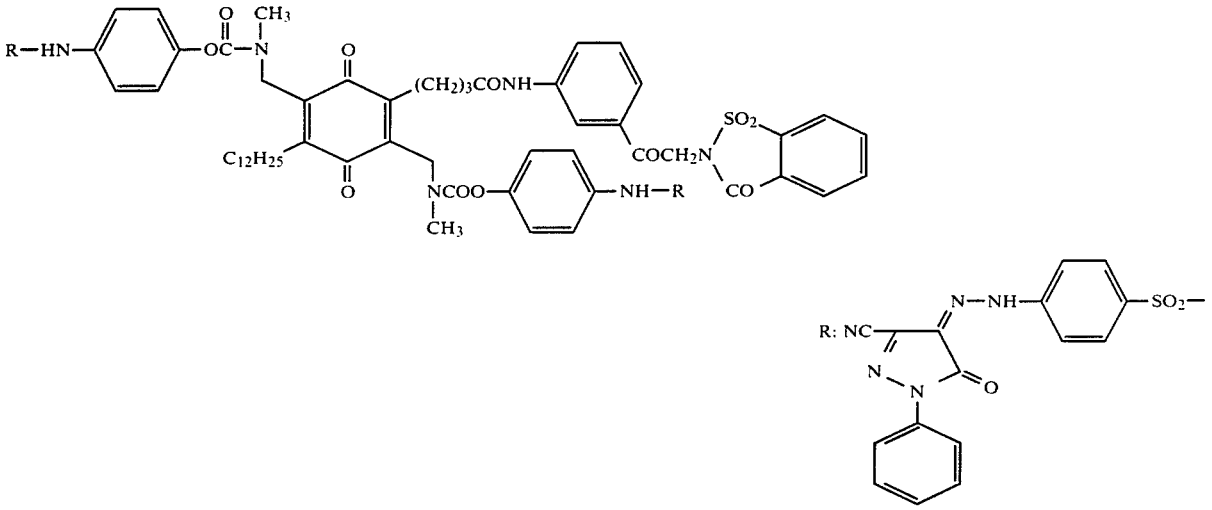
LDA-11
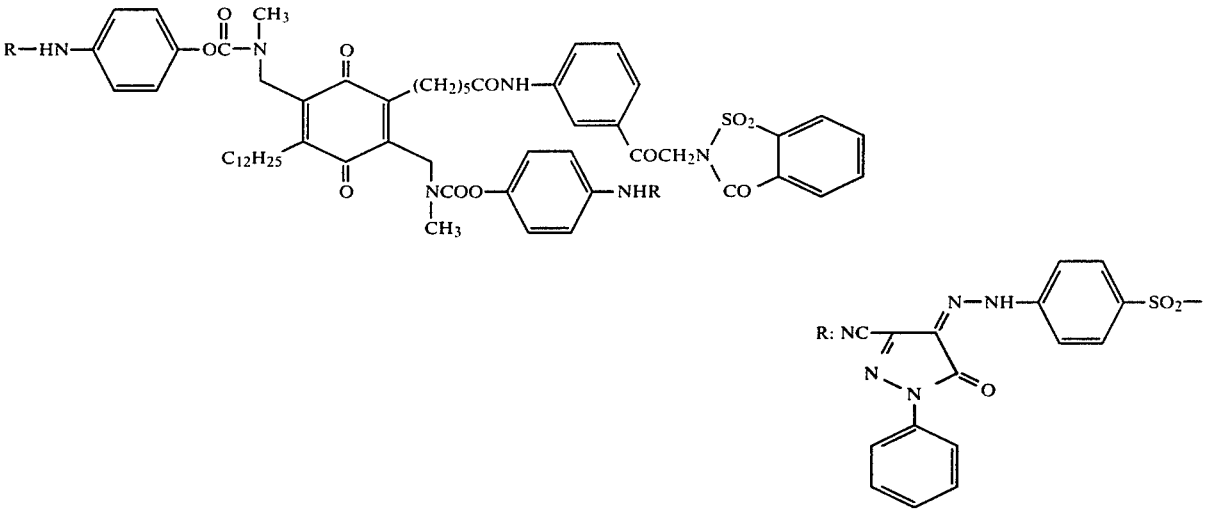
LDA-12

-continued
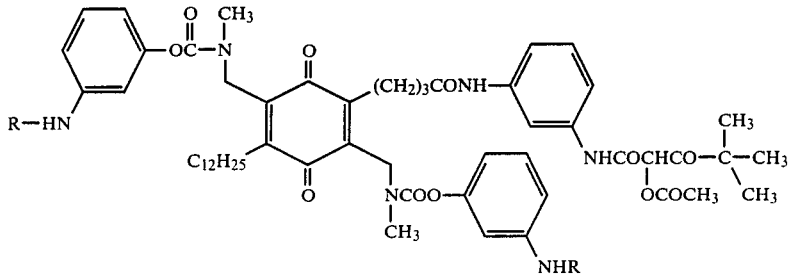
R:
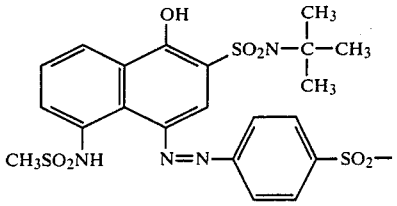
LDA-13
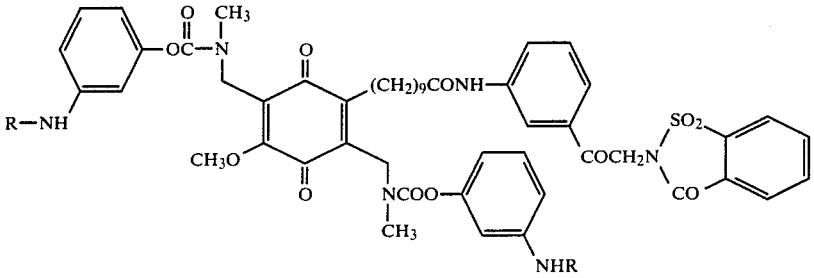
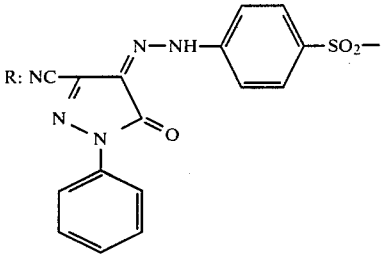
LDA-14
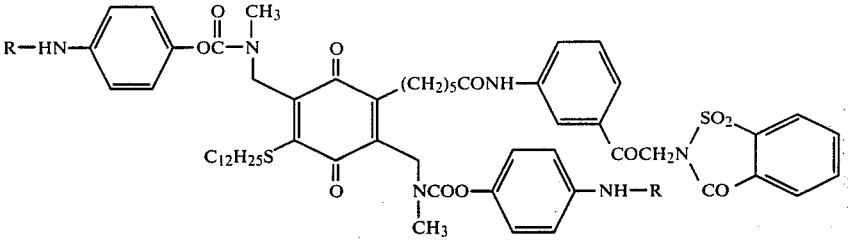
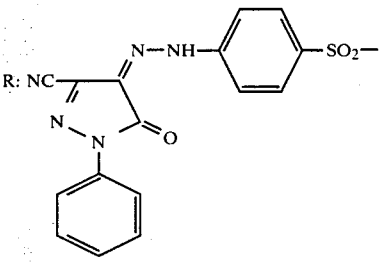
LDA-15

-continued
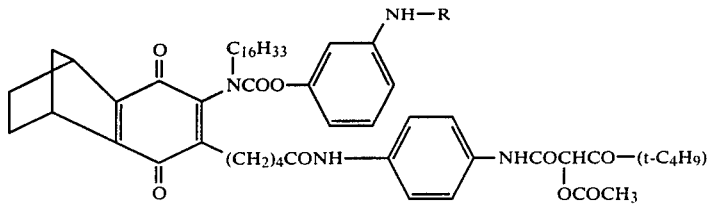
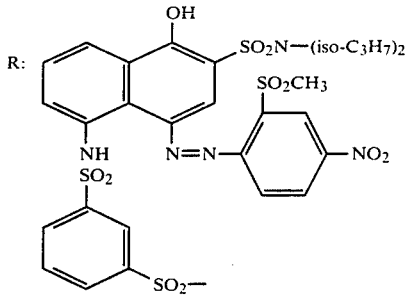
LDA-16
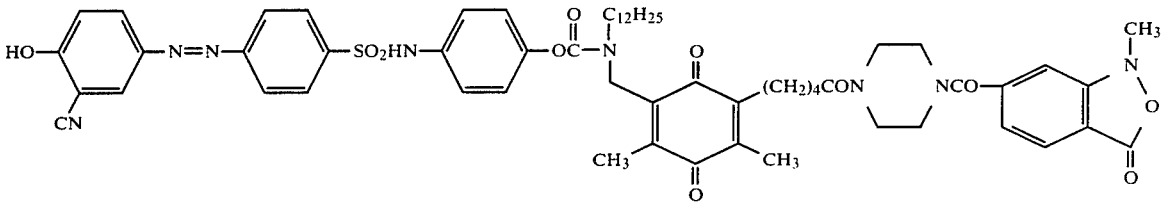
LDA-17
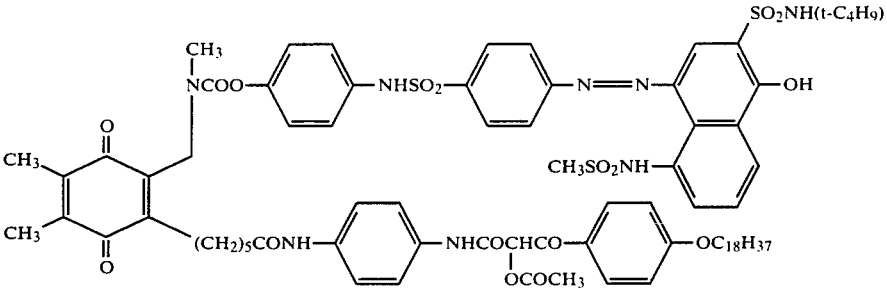
LDA-18
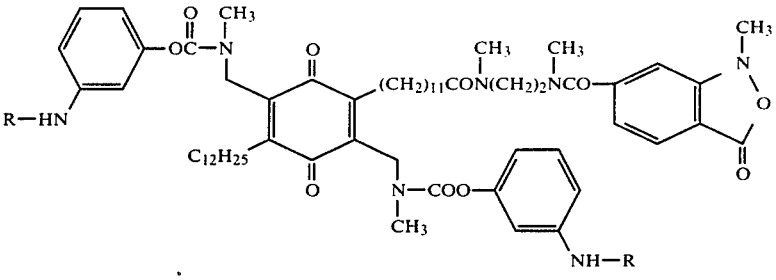
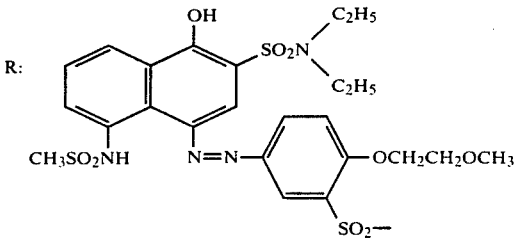

-continued
LDA-19
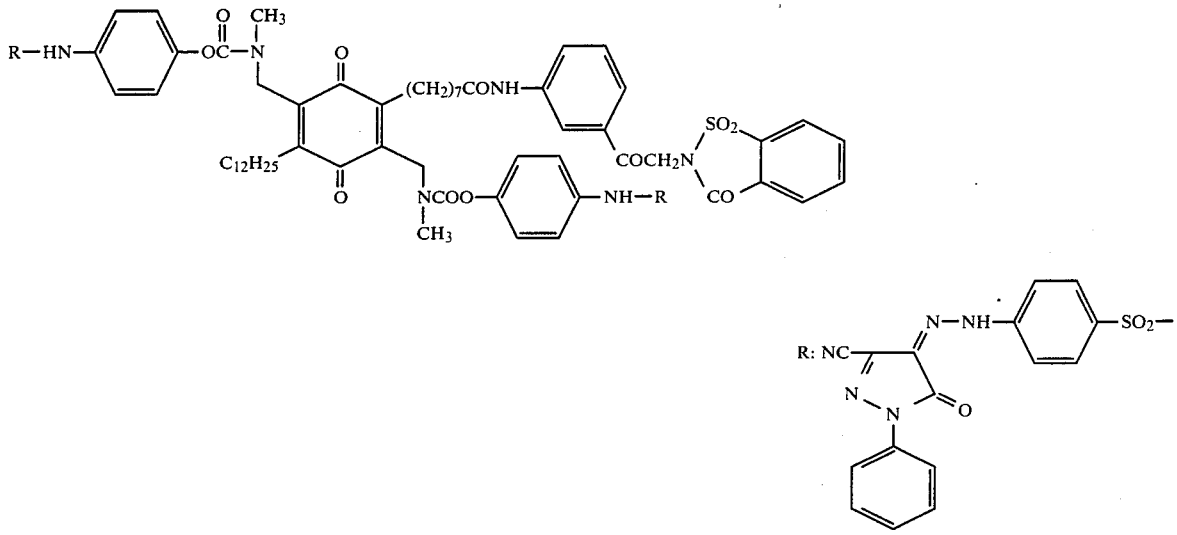
LDA-20
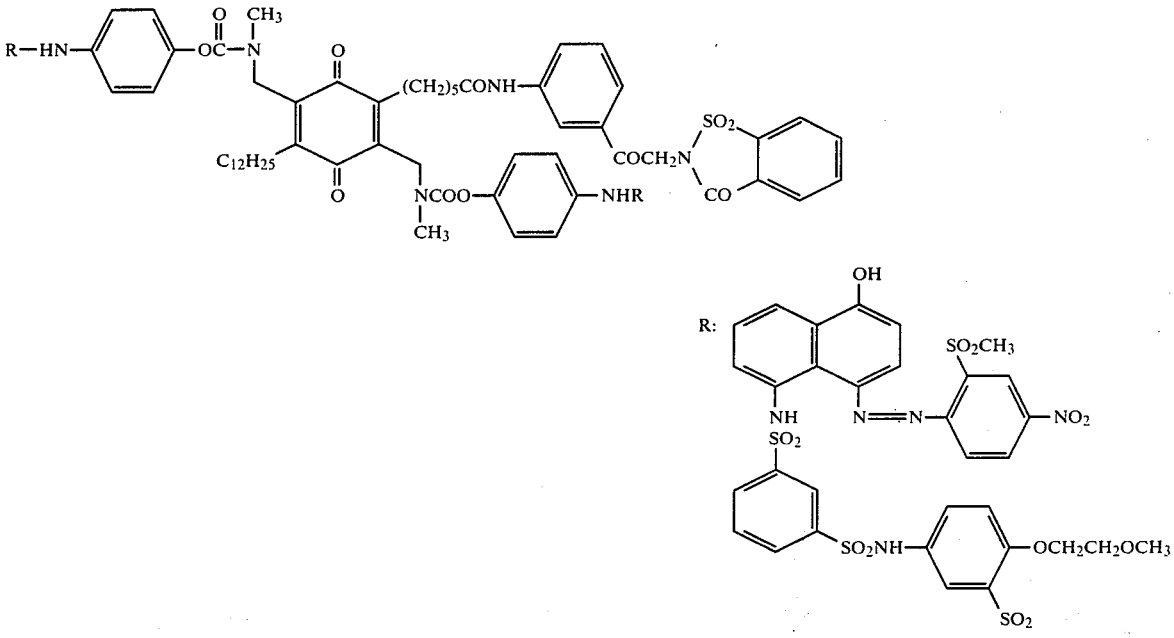
LDA-21
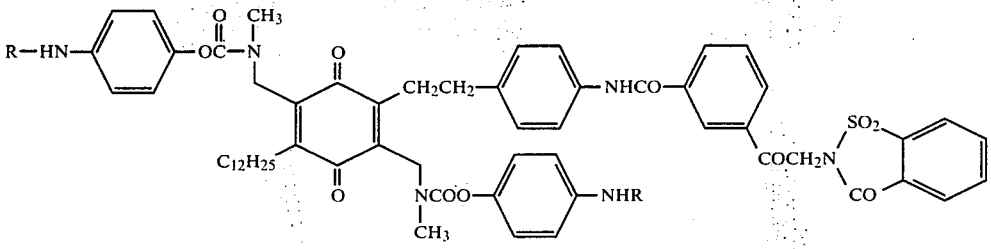

-continued
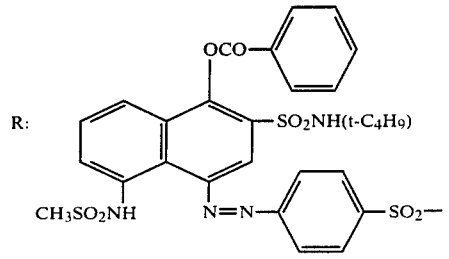
LDA-22
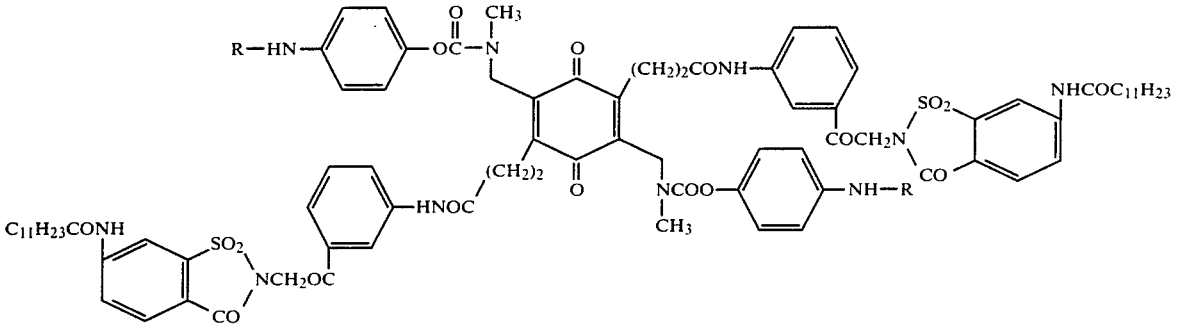
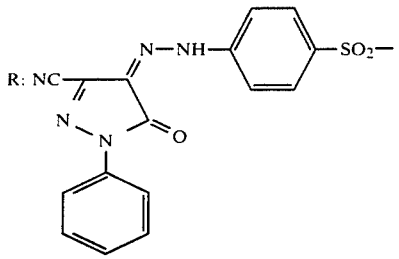
LDA-23
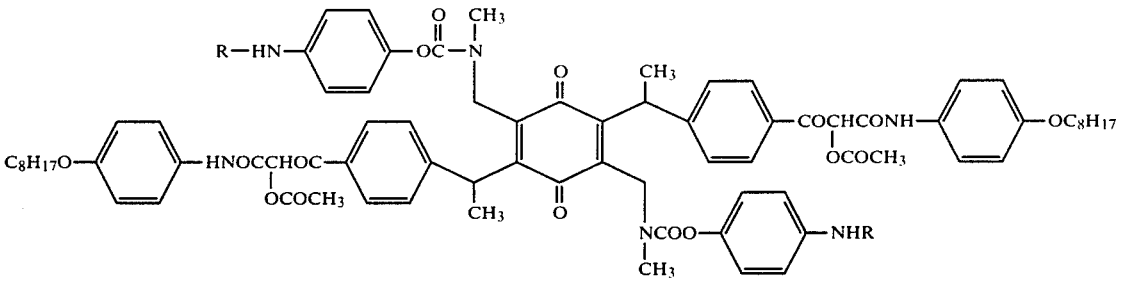
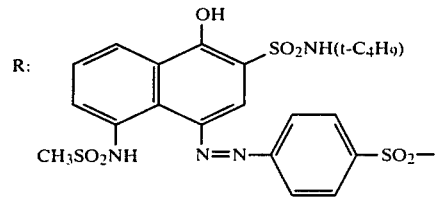
LDA-24

-continued
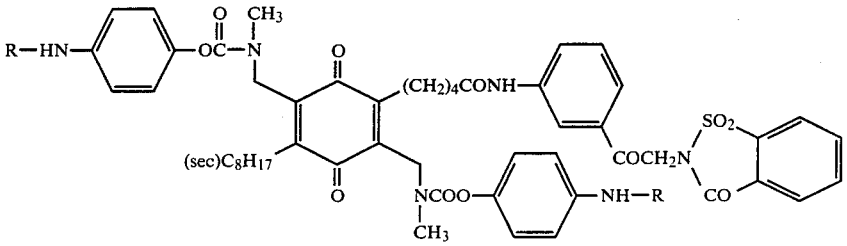
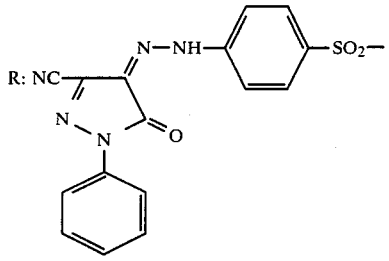
LDA-25
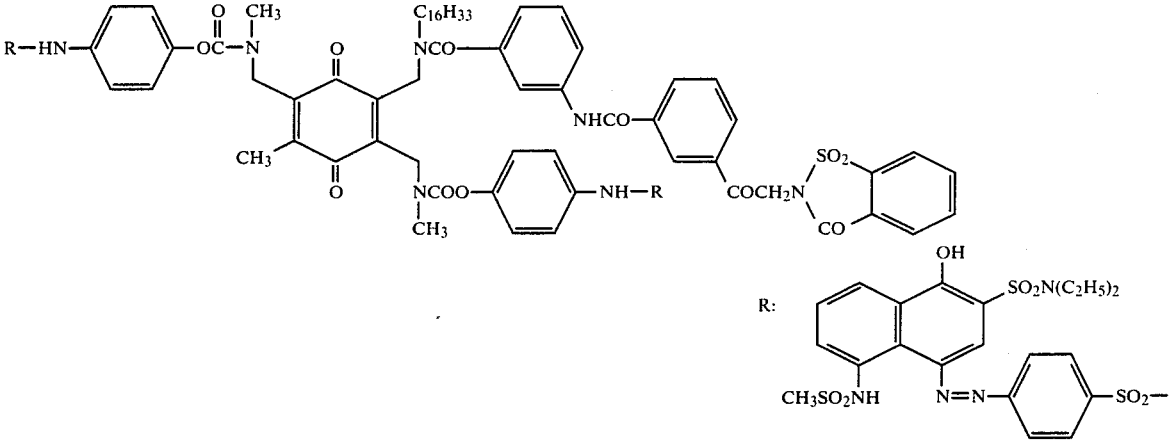
LDA-26
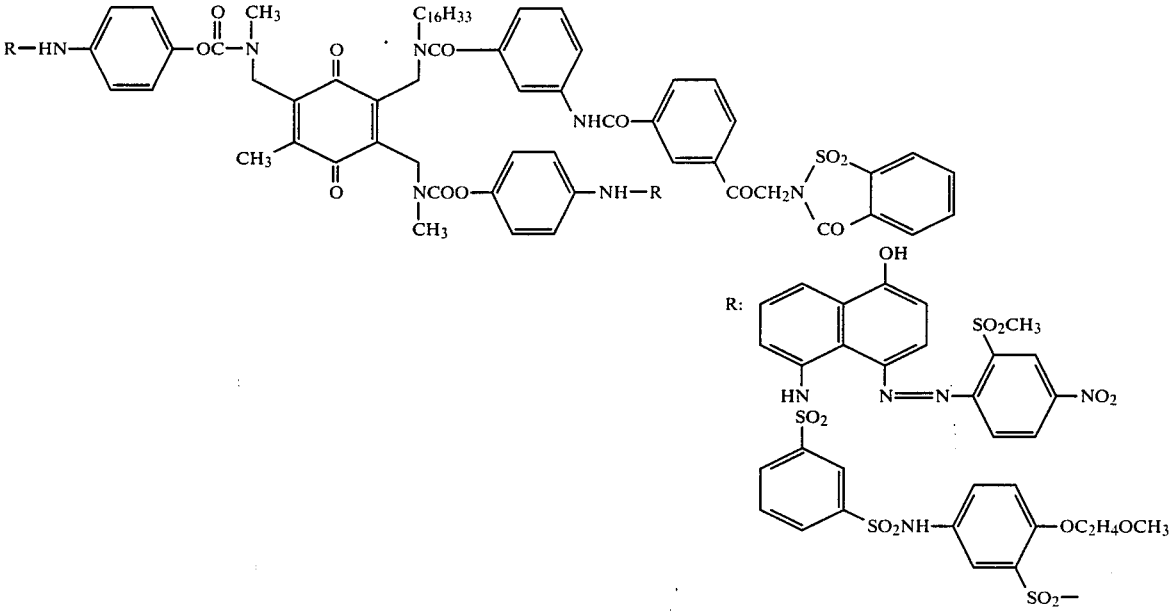

-continued
LDA-27
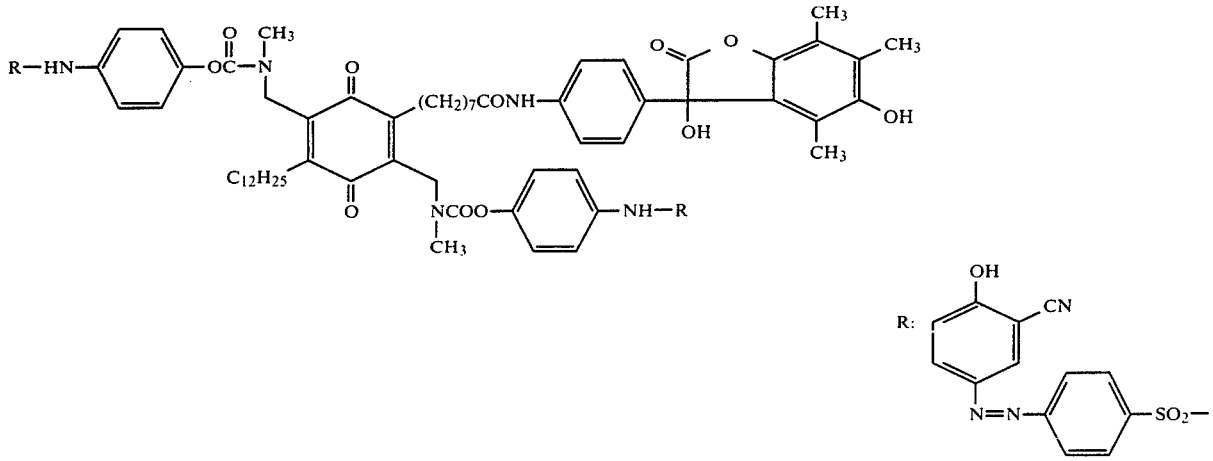
LDA-28
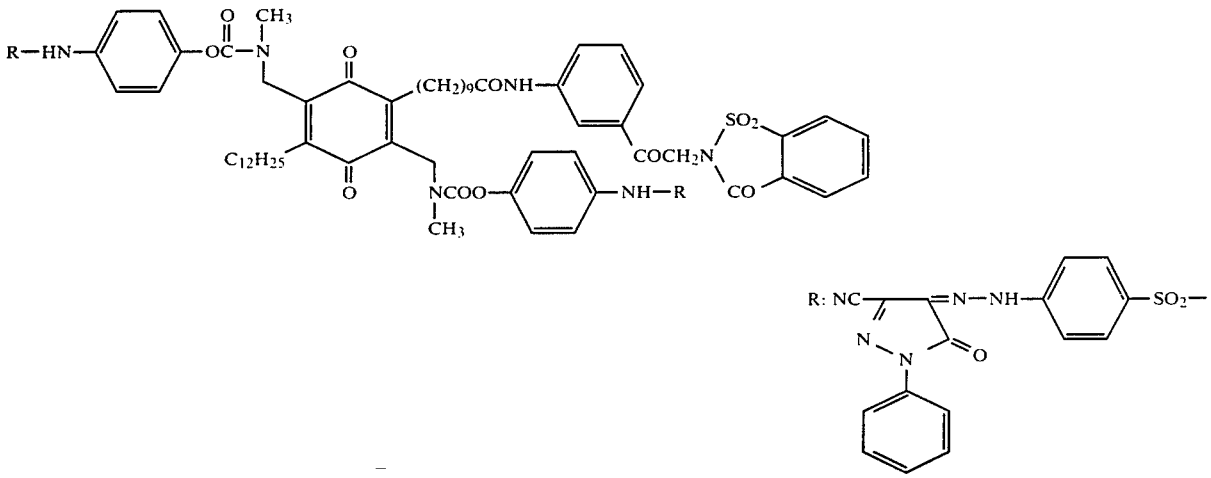
LDA-29
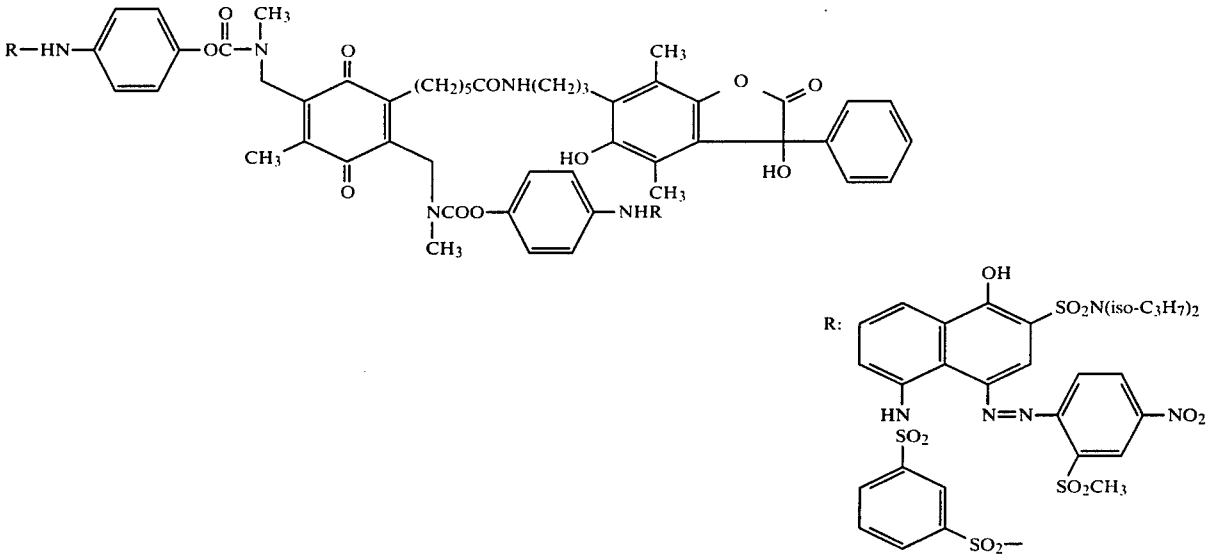
LDA-30

-continued
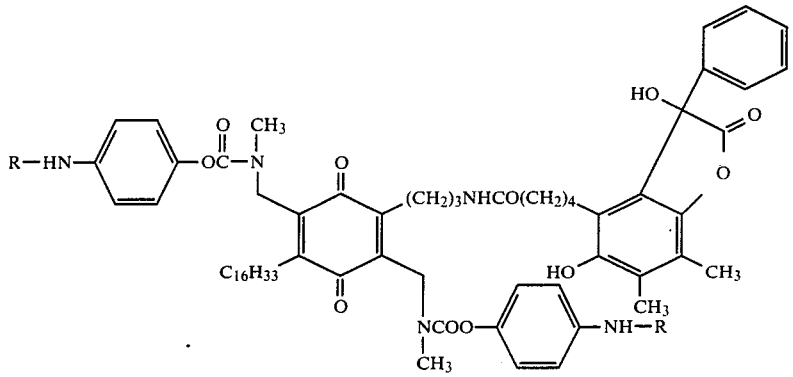
R:
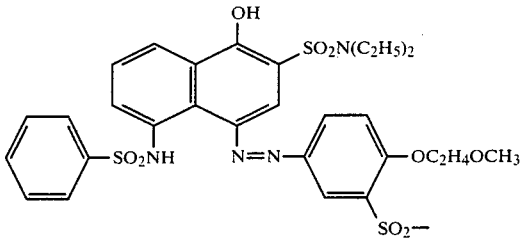
LDA-31
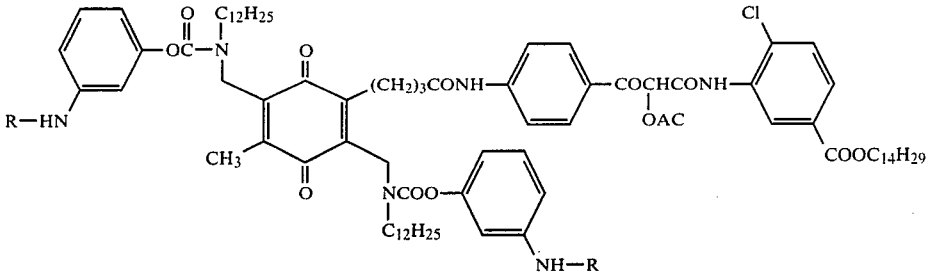
R:
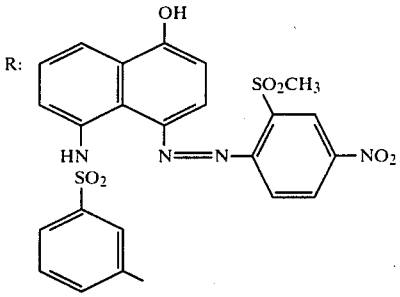
LDA-32
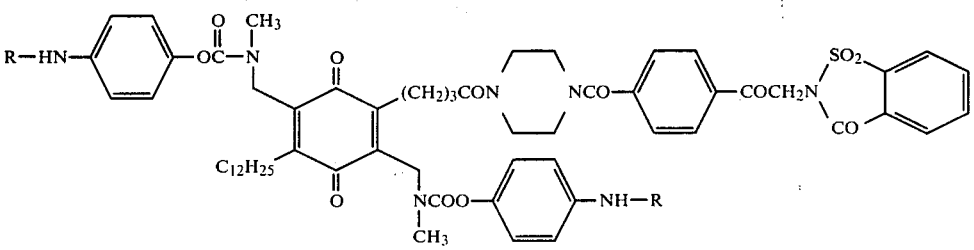

-continued
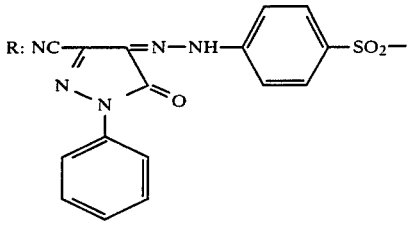
LDA-33
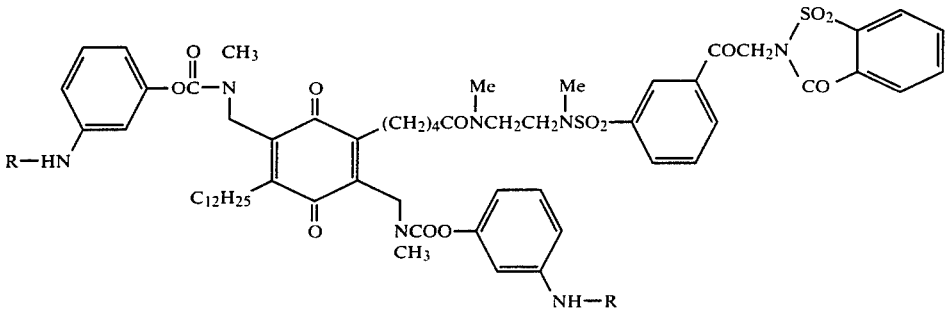
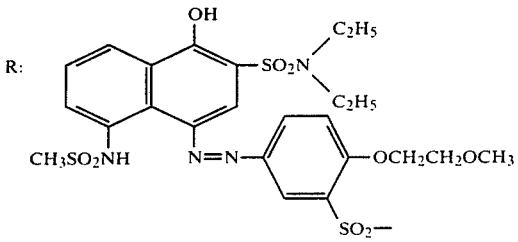
LDA-34
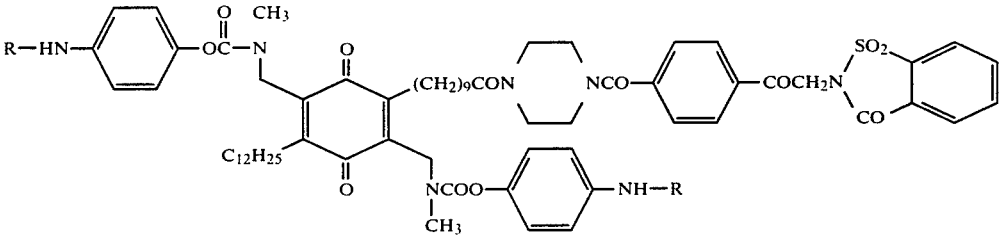
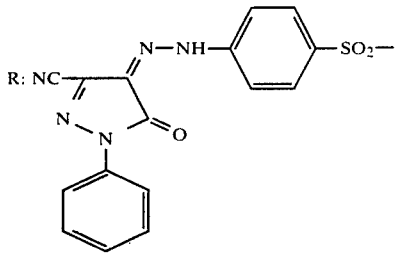
LDA-35
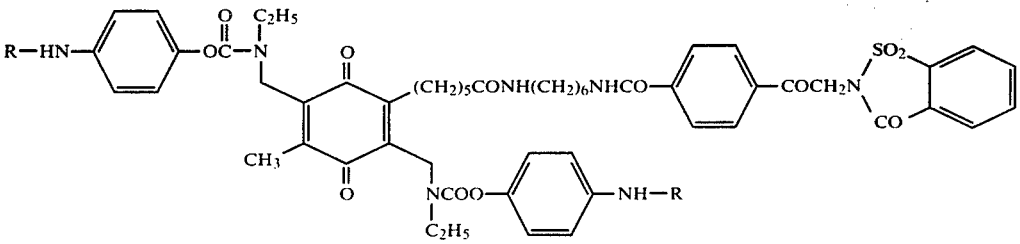

-continued

R:

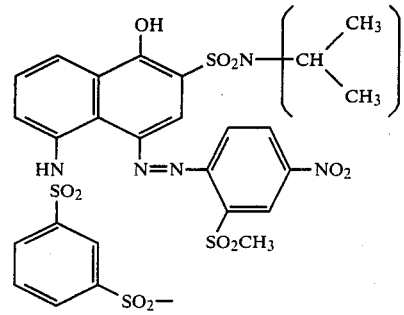

LDA-36

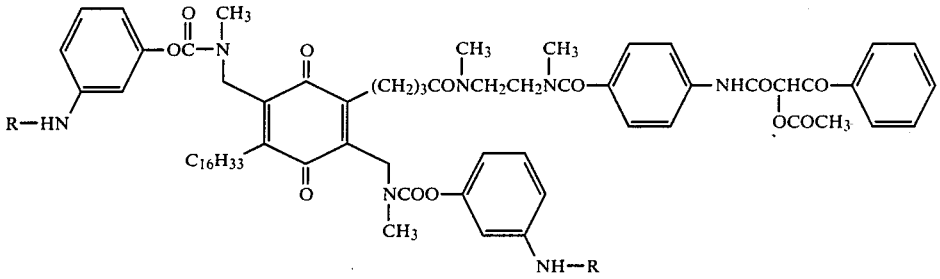

R:

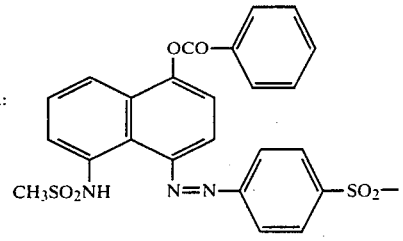

The LDA compound of the general formula (I) in this invention can generally be synthesized by reacting a sulfonyl chloride of an azo dye with an LDA nucleus containing an amino group. Generally, this reaction is preferably carried out in the presence of an organic base (e.g., triethylamine, N,N-diethylamine and pyridine). Syntheses of the dye moiety and sulfonyl chloride thereof are described in Japanese Patent Application (OPI) Nos. 12581/73, 33826/73, 114424/74 and 126332/74.

Examples of syntheses of some of the LDA compounds of the invention are described hereinafter.

SYNTHESIS 1

Synthesis of LDA-3

LDA-3 was synthesized in accordance with the reaction scheme shown below.

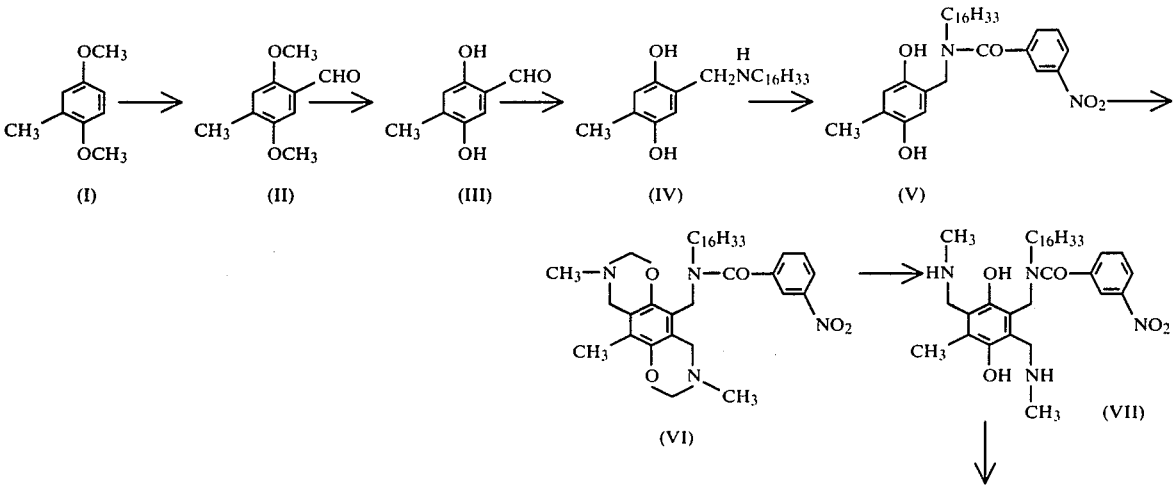

-continued
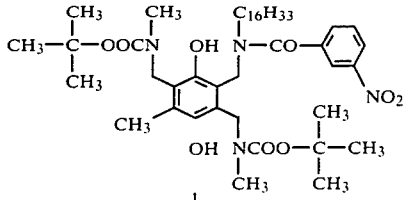
(VIII)
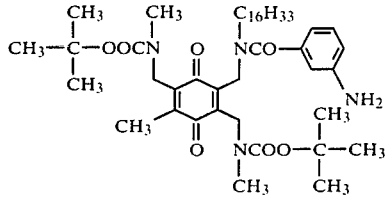
(IX)
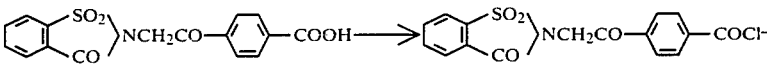
(X) (XI)
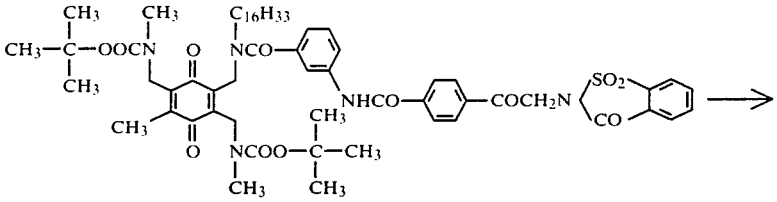
(XII)
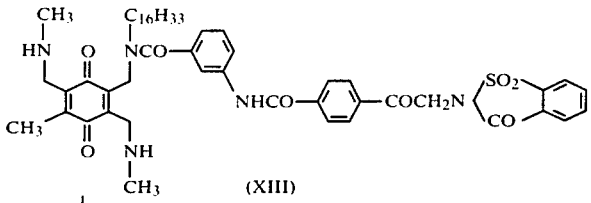
(XIII)
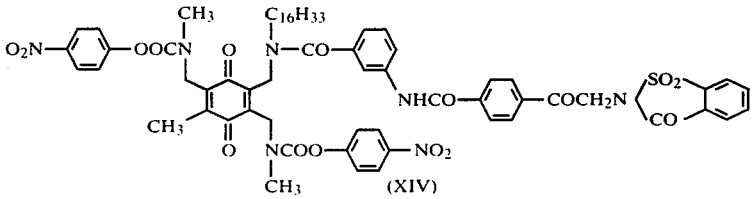
(XIV)

-continued

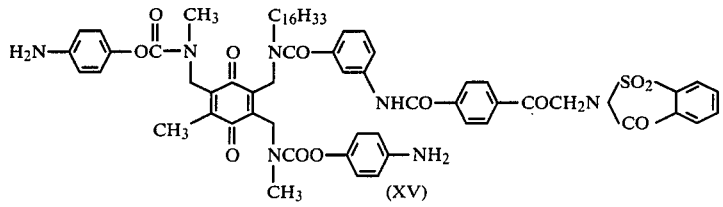

(XV)

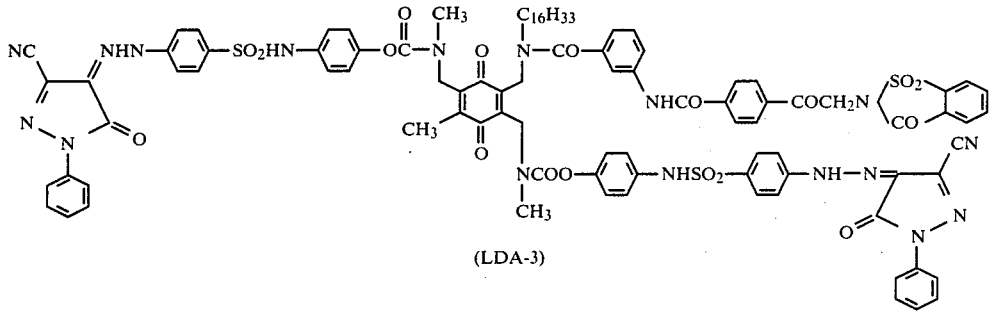

(LDA-3)

Synthesis of Compound (II)

370 g of 2,5-dimethoxytoluene (I) was dissolved in 1.2 liters of dimethylformamide. 1.5 kg of phosphorus oxychloride was added dropwise to the solution thus prepared with stirring. The dropwise addition rate was adjusted such that the reaction temperature did not exceed 80° C. After the dropwise addition was finished, the solution was stirred in a steam bath at a temperature of 80° C. to 90° C. for about 3 hours. The reaction mixture was poured into 20 liters of ice water to precipitate crystals. The crystals thus precipitated were filtered off and then recrystallized from hydrated methanol.

Yield: 328 g (75%)

Synthesis of Compound (III)

390 ml of boron tribromide was dissolved in 2.5 liters of dichloromethane. The solution thus prepared was cooled in an ice bath to a temperature of 5° C. or below. 408 g of Compound (II) was dissolved in 1 liter of dichloromethane. The solution of Compound (II) was added dropwise to the solution of boron tribromide at an internal temperature of 10° C. or below while stirring. After the dropwise addition was finished, the mixture was further stirred at room temperature for 1 hour. The reaction mixture was poured into 10 liters of ice water to precipitate crystals. The crystals thus precipitated were filtered off, washed with water, and dried.

Yield: 318 g (92%)

Synthesis of Compound (IV)

228 g of Compound (III) obtained by the above reaction, 361 g of hexadecylamine and 15 g of palladium carbon were hydrogenated in 2 liters of tetrahydrofuran in an autoclave at a temperature of 50° C. for 9 hours. After the solution was allowed to cool, the catalyst was removed off, and then the tetrahydrofuran was distilled off under reduced pressure. The residue was recrystallized from methanol to obtain Compound (IV).

Yield: 497 g (88%)

Synthesis of Compound (V)

233 g of Compound (IV) was dissolved in 1.5 liters of dimethylacetamide (DMAC). 200 ml of triethylamine was added to the solution thus prepared and stirred. A solution of 130 g of m-nitrobenzoyl chloride in tetrahydrofuran was added dropwise to the solution at a temperature of 15° C. to 20° C. After the dropwise addition was finished, the mixture was further stirred at room temperature for 1 hour. The solution was poured into dilute hydrochloric acid containing ice and extracted with ethyl acetate. The ethyl acetate layer was dried over magnesium sulfate, and the ethyl acetate distilled off under reduced pressure. The residual oil was allowed to stand overnight for solidification and then recrystallized from acetonitrile.

Yield: 197 g (60%)

Synthesis of Compound (VI)

197 g of Compound (V) obtained by the above reaction and 220 g of N,N-(diisobutoxymethyl)methylamine were dissolved in 640 ml of xylene. The solution thus prepared was refluxed for about 7 hours. After the xylene was distilled off under reduced pressure, methanol was added to the residual pale amber-colored oil for crystallization. The crystals were filtered off and washed with methanol to obtain Compound (VI).

Yield: 172 g (72%)

Synthesis of Compound (VII)

170 g of Compound (VI) was refluxed with 1 liter of ethanol and 250 ml of concentrated sulfuric acid for 48 hours. After the solvent was distilled off under reduced pressure for solidification, hexane was added for crystallization.

Yield: 121 g (67%)

Synthesis of Compound (VIII)

A suspension of 116 g of Compound (VII) in 2 liters of dichloromethane was treated with 104 ml of triethylamine and then with 65 g of di-t-butyl dicarbonate. After being stirred for about 1 hour, the suspension was treated with 1N hydrochloric acid containing ice and washed with saturated salt water. The dichloromethane layer was dried over sodium sulfate, and the solvent was distilled off to obtain an oil. The oil thus obtained was purified by means of column chromatography to obtain a pale yellow oil.

Yield: 78 g (57%)

Synthesis of Compound (IX)

76 g of Compound (VIII) as obtained above was hydrogenated with a palladium carbon catalyst in ethyl acetate. The reaction was finished in about three hours. The catalyst was filtered off, and the filtrate was treated with 30 g of manganese dioxide. After the reaction was finished, the manganese dioxide was filtered off, and the filtrate was concentrated to obtain 72 g of a pale brown oil. The oil (IX) thus obtained was used for the subsequent step without further purification.

Synthesis of Compound (XI)

100 g of N-(p-carboxyphenacyl)saccharin (X) was dissolved in 600 ml of thionyl chloride and then stirred at a temperature of 40° C. to 50° C. for about 30 minutes. The excess thionyl chloride was distilled off under reduced pressure, and the residue was allowed to stand overnight for solidification. The residue thus solidified was recrystallized from acetonitrile.

Yield: 57.2 g (54%)

Synthesis of Compound (XII)

72 g of Compound (IX) was dissolved in 600 ml of tetrahydrofuran. 30 ml of pyridine was further added to the solution and stirred. 34 g of N-(p-chloroformylphenacyl)saccharin (XI) was gradually added to the solution at a temperature of 20° C. or below. The mixture was further stirred at room temperature for one hour, poured into dilute hydrochloric acid containing ice, and extracted with ethyl acetate. After the ethyl acetate layer was dried over magnesium sulfate, the ethyl acetate was distilled off. The residue was purified by means of column chromatography with a 1:1 hexane-ethyl acetate solvent.

Yield: 82 g (79%)

Synthesis of Compound (XIII)

39 g of Compound (XII) obtained by the above reaction was dissolved in 100 ml of trifluoroacetic acid and then stirred at room temperature for 1 hour. After being further stirred at a temperature of 40° C. to 50° C. for 30 minutes, the solution was poured into ice water, extracted with ethyl acetate, and then thoroughly washed with saturated sal water. After the ethyl acetate layer was dried over Glauber's salt, the ethyl acetate was distilled off. As the result, Compound (XIII) was obtained in the form of a pale yellow oil. The compound thus obtained was used for the subsequent step without further purification.

Synthesis of Compound (XIV)

14.8 g of Compound (XIII) was dissolved in 150 ml of acetone, mixed with 15.3 g of diisopropylethylamine with stirring, and then cooled with ice. 4.8 g of p-nitrophenylchloroformate was added to the solution and stirred for 10 minutes. The mixture was then poured into diluted hydrochloric acid and extracted with ethyl acetate. After the ethyl acetate layer was dried over Glauber's salt, the solvent was distilled off. The residue was purified by means of column chromatography with a 3:2 ethyl acetate-hexane solvent to obtain a yellow oil which was later identified by thin layer chromatography as a single compound.

Yield: 6.7 g (46%)

Synthesis of Compound (XV)

A mixture of 13.2 g of Compound (XIV), 60 ml of acetic acid, 140 ml of isopropyl alcohol, 0.5 g of ammonium chloride and 40 g of iron powder was prepared and heated to a temperature of 80° C. to 90° C. Upon the commencement of reflux, 5 ml of water was added to the mixture and stirred for 1 hour. After the reaction was finished, the reaction mixture was filtered off, and the filtrate was concentrated. Water was added to the residue for crystallization. The crystals thus precipitated were filtered off. The crystals thus obtained were dissolved in 200 ml of acetone and oxidized with 10 g of manganese dioxide. After the manganese dioxide was filtered off, the solvent was distilled off. The residue was used for the subsequent step without further purification.

Synthesis of LDA-3

12 g of Compound (XV) obtained by the above step was dissolved in 80 ml of dimethylacetamide. 4 ml of pyridine was added to the solution thus prepared and stirred. 6.4 g of sulfonylchloride[3-cyano-1-phenyl-4-(4-chlorosulfonylphenylazo)pyrazolon] as a corresponding dye was added to the solution and stirred at room temperature for 1 hour. The reaction mixture was poured into dilute hydrochloric acid and extracted with ethyl acetate. The ethyl acetate layer was dried over magnesium sulfate, concentrated, and then separated and purified by means of column chromatography. The residue thus purified was crystallized from ethanol. As the result, LDA-3 having a melting point of 150° C. to 156° C. was obtained.

Yield: 13.2 g (69%)

Synthesis 2

The compound represented by the general formula (II-a) shown below can be synthesized in accordance with the following synthesis route.

(II-a)
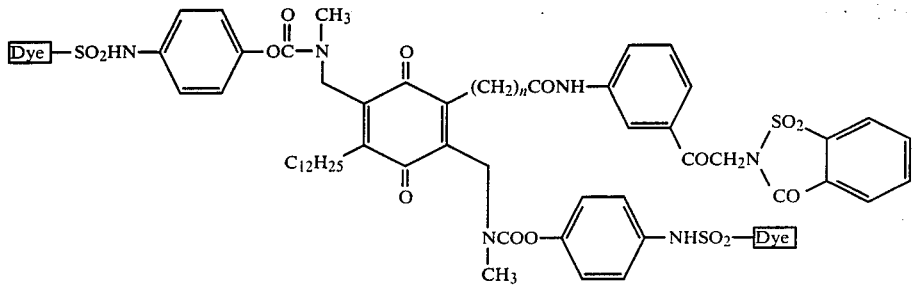
wherein Dye stands for a dye or its precursor moiety; and n stands for an integer of 3 to about 11.
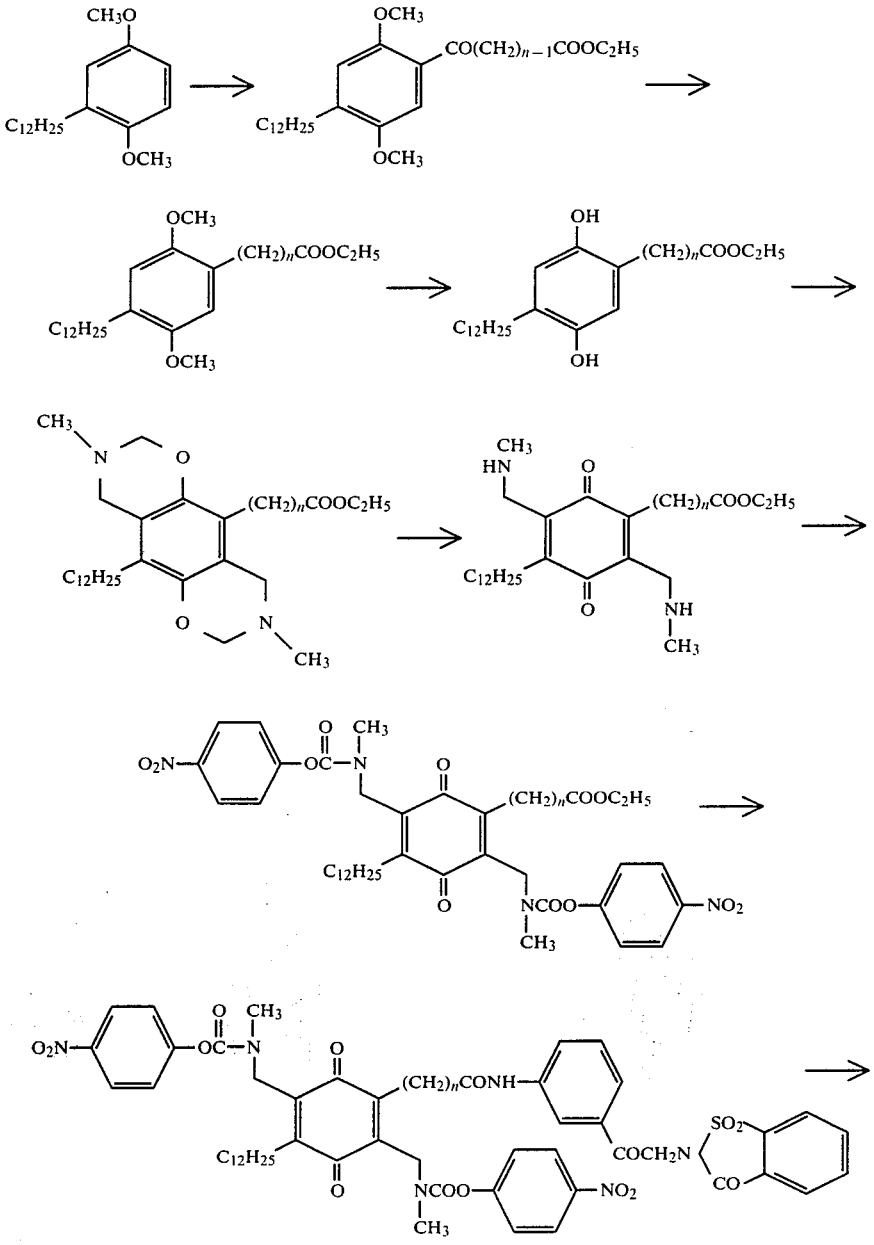

-continued

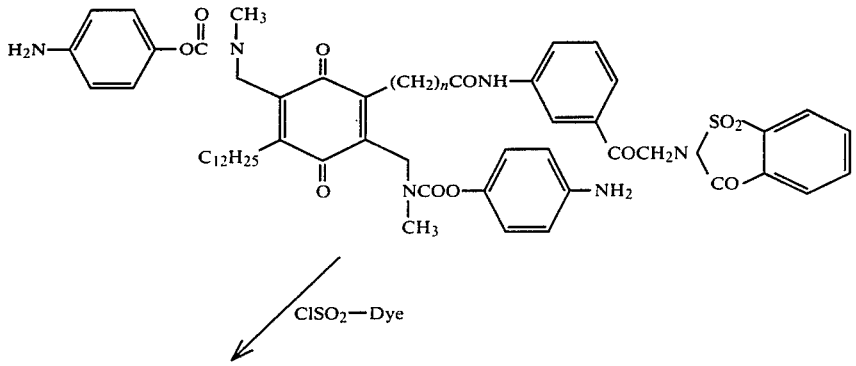

Compound of the general formula (II-a)

Other LDA compounds can be synthesized in accordance with the above described synthesis route.

The LDA compound of the invention can be used as a positive type coloring material for color photographic light-sensitive material. The LDA compound may be present in a silver halide emulsion layer or in other layer adjacent to the emulsion layer. When the light-sensitive material is exposed to light and treated with an alkaline treatment solution, in the area where silver development takes place, the electron donor moiety of the LDA compound is oxidized and deactivated by an oxidation product of the developing agent whereby no dye is released whereas in the area where silver development does not take place, electrons rapidly move from the electron donor moiety of the LDA compound to reduce the precursor of the nucleophilic group, whereby the precursor of the nucleophilic group is converted to a nucleophilic group and, at the same time, intermolecular nucleophilic displacement efficiently takes place so that a group (-Q-Col) containing a dye or its precursor moiety is rapidly released. A compound containing the dye or its precursor moiety released by such a reaction mechanism may be transferred to an image-receiving layer, or may be washed with water, bleached and fixed, to thereby obtain a color image. When a so-called ordinary type emulsion which develops depending on the amount of exposure is used, the transferred image is positive while the remaining image is negative. On the contrary, when a direct reversal emulsion, a DIR reversal emulsion described in U.S. Pat. Nos. 3,227,551, 3,227,554 and 3,364,022, or a reversal emulsion using dissolution physical phenomenon described in British Pat. No. 904,364 is used, the transferred image is negative while the remaining image is positive. Any one of or a combination of any types of negative and positive images may be used, if desired.

Suitable examples of the developing agent for the silver halide which can be used include hydroquinone compounds such as hydroquinone, 2,5-dichlorohydroquinone and 2-chlorohydroquinone; aminophenol compounds such as 4-aminophenol, N-methylaminophenol, 3-methyl-4-aminophenol and 3,5-dibromoaminophenol; catechol compounds such as catechol, 4-cyclohexyl catechol, 3-methoxy catechol and 4-(N-octadecylamino)catechol; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine and N,N,N',N'-tetramethyl-p-phenylenediamine; and 3-pyrazolidone compounds such as 1-phenyl-3-pyrazolidone, 1-phenyl-4,4-dimethyl-3-pyrazolidone, 4-hydroxymethyl-4-methyl-1-p-tolyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone. The preferred among these compounds are the 3-pyrazolidone compounds.

As the developing agent, there can be used combinations of various types of agents, as disclosed in U.S. Pat. No. 3,039,869. The developing agent may be added to the treatment solution or may be present at least in part in an appropriate layer (e.g., a silver halide emulsion layer, a coloring material-containing layer, an interlayer, an image-receiving layer, etc.) in the light-sensitive material (or film unit).

As the photographic emulsion used in the invention, there can be used any silver halide such as silver bromide, silver iodobromide, silver iodochlorobromide, silver chlorobromide and silver chloride. A preferred silver halide is silver bromide, silver iodobromide or silver iodochlorobromide having an iodide content of 20 mol% or less and a chloride content of 30 mol% or less. The most preferred is silver iodobromide containing 2 mol% to 15 mol% iodide.

Silver halide grains may have a phase in which the inner part of the grain and the surface layer thereof are different from each other or may have a homogeneous phase. Alternatively, the grains may be one wherein a latent image is formed on its surface or mainly in the inner part thereof.

The LDA compound of the invention is generally dispersed in a hydrophilic colloid as a carrier in a manner described hereinafter. Namely, the LDA compound of the invention is dissolved in an organic solvent and added to a solution of the hydrophilic colloid so that it is dispersed in the form of minute drop. Volatile solvents such as ethyl acetate, tetrahydrofuran and methyl ethyl ketone can be removed through the step for drying the photographic layer or by the methods described in U.S. Pat. Nos. 2,322,027 and 2,801,171. Readily water-soluble solvents such as dimethylformamide and 2-methoxyethanol may be washed and removed with water in a manner shown in U.S. Pat. Nos. 2,949,360 and 3,396,027. However, it is favorable that the LDA compound of the invention is incorporated in a solvent which is substantially water-insoluble and has a boiling point of 200° C. or above under atmospheric pressure in order to stabilize its dispersability and promote the formation of dye image. As such solvents, there can be selected dibutyl phthalate, tricresyl phosphate, trihexyl phosphate, tricyclohexyl phosphate and N,N-diethyl lauramide. It is desired that such volatile or water-soluble solvents as shown above are auxiliarily used in order to promote the dissolution of the LDA compound.

Alternatively, an oleophilic polymer, may be used instead of or in addition to such a high boiling solvent.

The dispersion of the LDA compound is remarkably promoted by the use of a surface active agent as an emulsification aid. Useful surface active agents are described, for example, in, the above cited patents and Japanese Patent Application Publication No. 4923/64 and U.S. Pat. No. 3,676,141.

As the hydrophilic colloid used for the dispersing the LDA compound, there can be selected gelatin, colloidal albumin, casein, cellulose derivatives such as carboxymethyl cellulose and hydroxyethyl cellulose, agar-agar, sodium alginate, sugar derivatives such as starch derivatives, and synthetic hydrophilic colloids such as polyvinyl alcohol, poly-N-vinyl pyrrolidone, polyacrylic acid copolymers and polyacrylamide or derivatives thereof (e.g., partial hydrolyzates). A compatible mixture of two or more of these colloids may be used, if desired. The most frequently used among the above colloids is gelatin. Gelatin may be entirely or partially replaced by a synthetic hydrophilic colloid.

The coating amount of the LDA compound is $1\times10^{-4}$ to $10^{-2}$ mole/m$^2$, preferably $2\times10^{-4}$ to $2\times10^{-3}$ mole/m$^2$.

The treatment composition used to treat the photographic light-sensitive material of the invention favorably contains a base such as sodium hydroxide, potassium hydroxide, sodium carbonate and sodium phosphate so that the pH thereof is about 9 or more, preferably has an alkalinity of 11.5 or more. The treatment composition may further contain an antioxidant such as sodium sulfite, ascorbates and piperidinohexose reductone, or a silver ion concentration controlling agent such as potassium bromide. Alternatively, the treatment composition may contain a thickening agent such as hydroxyethyl cellulose and sodium carboxymethyl cellulose.

Furthermore, the alkaline treatment composition of the invention may contain a compound capable of promoting the development or the diffusion of dye, such as benzyl alcohol.

For reproduction of natural colors by substractive color process, a light-sensitive material comprising a least two of combinations of a silver halide emulsion having a selective spectral sensitivity in a certain wavelength region and LDA compound containing the dye moiety having a selective spectral absorption in the above-described wavelength region is used.

In particular, a light-sensitive element comprising a combination of a blue sensitive silver halide emulsion and a positive type yellow coloring material (LDA compound), a combination of a green sensitive silver halide emulsion and a magenta coloring material (LDA compound) and a combination of a red sensitive silver halide emulsion and a cyan coloring material (LDA compound) is useful. The unit of the combination of these emulsions and coloring materials may be applied in a layer in a face-to-face relationship in the light-sensitive material or may be granulated so that the positive type coloring material and the silver halide grain are present in the same grain, mixed and applied as a single layer.

A scavenger for oxidized developer can be used for various interlayers of the photographic light-sensitive material of the invention to prevent color mixing. As the scavenger which can be used in the invention, there can be employed di-straight chain alkylhydroquinones described in U.S. Pat. Nos. 2,728,659 and 2,732,300 and Japanese Patent Publication No. 15745/69; di-branched chain alkylhydroquinones described in U.S. Pat. No. 2,732,300, Japanese Patent Publication Nos. 15745/69 and 106329/74, Japanese Patent Application (OPI) Nos. 4819/77 and 29637/79; mono-straight chain alkylhydroquinones described in U.S. Pat. No. 2,728,649 and Japanese Patent Publication No. 106329/74; mono-branched chain alkylhydroquinones described in Japanese Patent Publication No. 15745/69 and Japanese Patent Application (OPI) Nos. 106329/74 and 156438/75; hydroquinones described in Japanese Patent Application (OPI) Nos. 109344/81, 17949/82 and 43521/80, and scavengers for developing agent oxidation products described in *Research Disclosure,* 18143, ibid., 18144 and ibid., 18169, Japanese Patent Application (OPI) Nos. 118831/79, 24941/82 and 125738/81.

An isolation layer may be provided between the interlayer and the layer containing a positive type coloring material as described in Japanese Patent Application (OPI) No. 52056/80. A silver halide emulsion may be added to the interlayer(s) as described in Japanese Patent Application (OPI) No. 67850/81.

When the light-sensitive material of the invention is used for color diffusion transfer process, layers described, for example, in Japanese Patent Application (OPI) No. 64533/77 may be applied as a mordant layer, neutralization layer or a neutralization rate adjusting layer (timing layer) which can be used for the light-sensitive material.

The polymer mordants used in the invention are polymers comprising secondary and tertiary amino groups, polymers having nitrogen-containing heterocyclic moieties, and polymers comprising quaternary cationionic groups thereof, each of which has a molecular weight of 5,000 or more, preferably 10,000 or more.

As examples of such mordants, there can be selected vinyl pyridine polymers and vinyl pyridinium cation polymers disclosed in U.S. Pat. Nos. 2,548,564, 2,484,430, 3,148,061 and 3,756,814; vinyl imidazolium cation polymers disclosed in U.S. Pat. No. 4,124,386; polymer mordants crosslinkable with gelatin disclosed in U.S. Pat. Nos. 3,625,694, 3,859,096 and 4,128,538 and British Pat. No. 1,277,453; aqueous sol type mordants disclosed in U.S. Pat. Nos. 3,958,995, 2,721,852 and 2,798,063 and Japanese Patent Application (OPI) Nos. 115228/79, 145529/79, 126027/79, 155835/79 and 17352/81; water-insoluble mordants disclosed in U.S. Pat. No. 3,898,088; reactive mordants which can be covalently bonded to the dye disclosed in U.S. Pat. Nos. 4,168,976 and 4,201,840; and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 30328/78, 155528/77, 125/78, 1024/78 and 107835/78, and British Pat. No. 2,064,802.

Furthermore, there can be selected mordants described in U.S. Pat. Nos. 2,675,316 and 2,882,156.

As the image-receiving layer mordanting an azo dye containing a chelating group, there may be preferably used a layer having a transition metal ion and a polymer which can immobilize the transition metal ion incorporated in the mordant layer or its adjacent layer. Examples of such polymers which can immobilize the transition metal ion are described in Japanese Patent Application (OPI) Nos. 48210/80 and 129346/80, and U.S. Pat. Nos. 4,273,853, 4,282,305, 4,193,796, 4,288,511 and 4,241,163.

In applying the light-sensitive material of the invention to color diffusion transfer photography, the film unit may be of peel-apart type, integrated type described in Japanese Patent Publication Nos. 16356/71 and 33697/73, Japanese Patent Application (OPI) No. 13040/75 and British Pat. No. 1,330,524, or non-peelable type described in Japanese Patent Application (OPI) No. 119345/82.

It is desired that any of the above types of formats uses a polymer acid layer protected by a temporary barrier layer which shortens the neutralization timing time at an elevated treatment temperature such as a molten latex polymer disclosed in Japanese Patent Application (OPI) Nos. 145217/77, 72622/78, 78130/79, 138432/79 and 138433/79 and a polymer containing a lactone ring disclosed in Japanese Patent Application (OPI) No. 54341/80 and *Research Disclosure,* 18425 (1979) for wider permissible range of treatment temperature.

The light-sensitive material of the invention can be applied also to heat development photography. The materials and developing process for the light-sensitive material used in the heat development process are described in Japanese Patent Application (OPI) No. 157798/81.

EXAMPLE 1

Light-sensitive elements 1 and 2 each having a yellow dye-donating LDA compound incorporated therein were prepared as follows:

Each of the light-sensitive elements was prepared by coating on a subbed polyethylene terephthalate film support a light-sensitive layer containing an emulsion prepared by dissolving silver iodobromide (0.005 g-atomic silver/$m^2$) and $2.5\times10^{-4}$ mol/$m^2$ of an LDA compound shown in Table 1 in the equal weight amount of diethyllaurylamide and then dispersing the solution in an aqueous solution of gelatin and 1.2 g/$m^2$ of gelatin, and then a protective layer which is a layer of gelatin (0.5 g/$m^2$) containing 3.3 mg/$m^2$ of bis(vinylsulfonylmethyl)ether as a hardener.

For comparison, light-sensitive elements R1, R2 and R3 were prepared in quite the same manner as above except that a combination of $2.5\times10^{-4}$ mol/$m^2$ of redoxes as shown in Table 1 such that the precursor of the electron donor (compound) and the positive type coloring material (substantially the same as the LDA compound of the invention except that it has no precursor moiety of electron donor) were in different molecules was contained therein instead of the LDA compound of the invention.

To measure the rate of dye-release, a treatment solution containing 38.2 g of potassium hydroxide, 3.0 g of 4-hydroxymethyl-4-methyl-1-phenyl-3-pyrazolidone and 56 g of carboxymethyl cellulose in 1 kg of finished solution was spread to a thickness of 56$\mu$ between each light-sensitive element from which the silver halide had been removed by a sodium thiosulfate fixing solution and an image-receiving sheet. The image-receiving layer was prepared by coating on a subbed polyethylene phthalate support 3.0 g/$m^2$ of gelatin and 3.0 g/$m^2$ of poly(vinylbenzylmethylpiperidinium chloride-CO-styrene-CO-divinylbenzene). The spreading was conducted at temperatures of 15° C., 25° C. and 35° C. with the aid of pressure rollers.

Parts of the above laminates were peeled off at treatment times of 0.5 min, 0.75 min, 1 min, 1.25 min, 1.5 min, 1.75 min, 2 min, 2.25 min, 2.5 min, 3 min, 5 min, 10 min and 20 min. The time (half release time) corresponding to the half of the dye density transferred at the time of peeling at the 20 min treatment was determined at each temperature by interpolation. The results are shown in Table 1. The LDA compounds of the invention were proved to be much faster in the rate of dye-release than the prior art combinations of redoxes which are different molecules.

TABLE 1

| Light-Sensitive Element | LDA Compound or Combination of Different Redoxes | Half Release Time (min.) | | |
|---|---|---|---|---|
| | | 15° C. | 25° C. | 35° C. |
| 1 (Invention) | LDA-1 | 1.60 | 0.83 | 0.61 |
| 2 (Invention) | LDA-3 | 1.90 | 1.00 | 0.69 |
| 3 (Invention) | LDA-5 | 2.03 | 1.07 | 0.73 |
| R1 (Comparison) | Compound A + Compound B | 2.52 | 1.52 | 1.37 |
| R2 (Comparison) | Compound A + Compound C | 8.19 | 2.81 | 1.88 |
| R3 (Comparison) | Compound D + Compound E | 9.05 | 3.03 | 1.96 |

R1, R2 and R3 stand for comparative samples corresponding to light-sensitive elements 1, 2 and 3, respectively.

Compound A

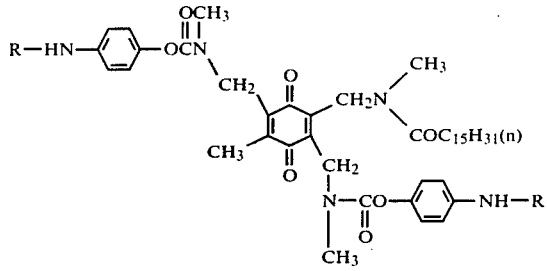

wherein R is defined as with LDA-1 and LDA-3.

Compound B

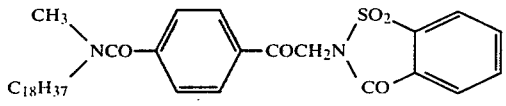

Compound C

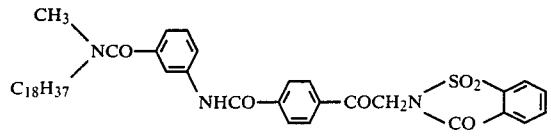

Compound D

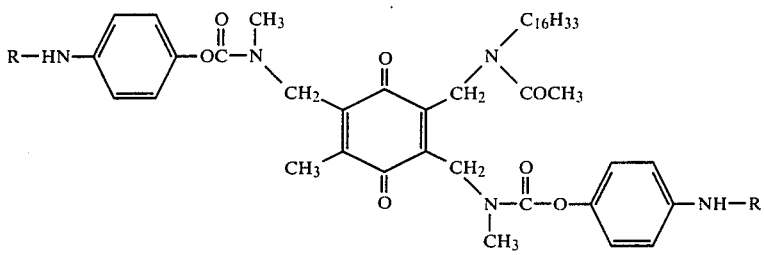

Compound E

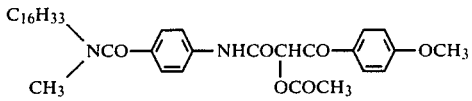

EXAMPLE 2

Light-sensitive elements 4 to 8 each having the LDA compound of the invention shown in Table 2 incorporated therein were prepared in the same manner as Example 1. For comparison, light-sensitive elements R4 to R7 were similarly prepared using corresponding combinations (prior art) of compounds each having a precursor of electron donor and a positive type coloring material which were in different molecules from each other.

These light-sensitive elements were measured in the same manner as Example 1 for the dye generation rate at 25° C. from which the half release time was then determined. The results are shown in Table 2.

As can be seen in Table 2, the LDA compounds of the invention were proved to be excellent compounds having a much higher rate of dye-release than the prior art combinations of compounds each having a positive type nucleus and a precursor of electron donor (ED) which were in different molecules from each other. Furthermore, remarkable changes of performance can be recognized depending on the manner in which the redox nucleus moiety and the precursor moiety of electron donor in the LDA are bonded to each other, showing that the intermolecular redox reactivity changes drastically. On the contrary, in the case of the comparative compounds, the performance does not depend on the length of X. Thus, the LDA compounds of the invention which use intermolecular redox reaction were proved to be excellent compounds having very excellent redox reactivity which are quite different from the conventional known compounds.

TABLE 2

| Invention | | | | Comparative Compounds | | |
|---|---|---|---|---|---|---|
| X = —L—CNH— (O) 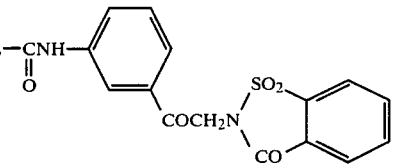 | | | | X = —L—COC$_2$H$_5$ (O) (combined with the equal mol of Compound F as ED which is a different molecule therefrom) | | |
| Sensitized Element | Compound No. | L | Half Release Time (min) | Light-Sensitive Element | L | Half Release Time (min) |
| 4 | LDA-10 | —(CH$_2$)$_3$— | 0.85 | R4 | —(CH$_2$)$_3$— | 2.67 |
| 5 | LDA-11 | —(CH$_2$)$_5$— | 0.93 | R5 | —(CH$_2$)$_5$— | 2.78 |
| 6 | LDA-19 | —(CH$_2$)$_7$— | 1.13 | R6 | —(CH$_2$)$_7$— | 2.61 |
| 7 | LDA-28 | —(CH$_2$)$_9$— | 1.45 | R7 | —(CH$_2$)$_9$— | 2.55 |

TABLE 2-continued

| Invention | | | | Comparative Compounds | | |
|---|---|---|---|---|---|---|
| X = —L—CNH— (O) 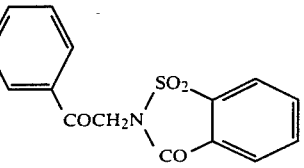 | | | | X = —L—COC$_2$H$_5$ (O) (combined with the equal mol of Compound F as ED which is a different molecule therefrom) | | |
| Sensitized Element | Compound No. | L | Half Release Time (min) | Light-Sensitive Element | L | Half Release Time (min) |
| 8 | LDA-32 | 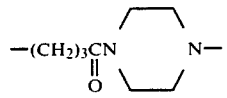 | 0.62 | R6 | —(CH$_2$)$_7$— | 2.61 |

*Half release time: (min)

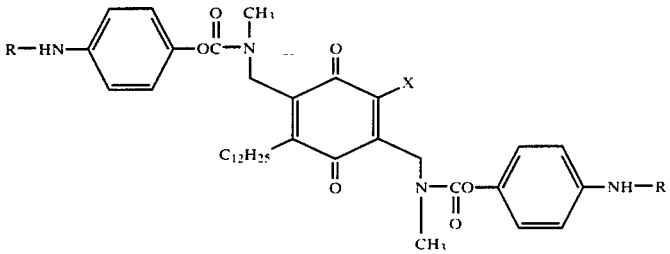

(R is defined as with LAD-10, -11, -19, -28 and -32.)

Compound F (precursor of electron donor)

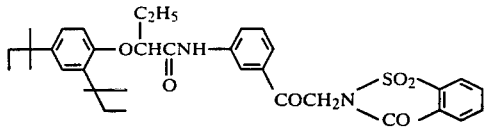

EXAMPLE 3

Light-sensitive sheets, cover sheets and treatment solutions used for color diffusion transfer photography were prepared as follows:

Light-sensitive sheets were prepared by coating on a transparent polyethylene terephthalate support the following layers (1) to (6):

(1) An image-receiving layer containing 3.0 g/m$^2$ of the same quaternary ammonium type mordant polymer latex as used for the image-receiving layer in Example 1, 3.0 g/m$^2$ of gelatin, and as a coating aid 0.3 g/m$^2$ of nonylphenyl polyethylene oxide.

(2) A white reflective layer containing 17.6 g/m$^2$ of titanium dioxide and 2.5 g/m$^2$ of gelatin.

(3) A light-shielding layer containing 2.0 g/m$^2$ of carbon black and 1.5 g/m$^2$ of gelatin.

(4) A layer containing $5.0\times10^{-4}$ mole/m$^2$ of the LDA compound shown in Table 3 (in the form of a dispersion of a solution in the equal weight amount of diethyllaurylamide) and 1.0 g/m$^2$ of gelatin.

(5) A layer containing a silver iodobromide emulsion (iodine content: 6.0%; silver coating amount: 0.35 g/m$^2$) for forming a latent image mainly on the surface of grain.

(6) A protective layer containing 1.0 g/m$^2$ of gelatin.

Cover sheets were prepared by coating on a transparent polyethylene terephthalate support the following layers (1') to (3') in that order.

(1') A layer containing 22 g/m$^2$ of a copolymer of 80:20 (by weight) of acrylic acid and butyl acrylate and 0.44 g/m$^2$ of 1,4-bis(2,3-epoxypropoxy)butane.

(2') A layer containing 3.8 g/m$^2$ of acetyl cellulose (forming 39.4 g of acetyl group upon hydrolysis of 100 g of acetyl cellulose), 0.23 g/m$^2$ of a methanol ring opening compound of a copolymer (molecular weight: about 50,000) of 60:40 (by weight) of styrene and maleic anhydride, and 0.154 g/m$^2$ of 5-(2-cyano-1-methylethylthio)-1-phenyltetrazole.

(3') A 2$\mu$ thick layer of a coat of a 6:4 mixture by solid ratio of a 49.7:42.3:3:5 copolymer latex of styrene, n-butyl acrylate, acrylic acid and N-methylol acrylamide, and a 93:4:3 copolymer latex of methyl methacrylate, acrylic acid and N-methylol acrylamide.

Comparative light-sensitive sheets R1 and R2 were prepared having the same layer structure as the above described light-sensitive sheets except that a layer containing $5.0\times10^{-4}$ mole/m$^2$ of a coating matter emulsion which had been prepared by dissolving the same combination (1:1 by mole) of redoxes as Example 1 in the equal weight amount of diethyllaurylamide and dispersing the solution in an aqueous solution of gelatin and 1.0 g/m$^2$ of gelatin was contained in the layer (4).

After imagewise exposing, each of the light-sensitive sheets was laminated with each cover sheet. The treatment solution shown below was then spread to a thickness of 85$\mu$ between the both sheets. Table 3 shows the minimum density (Dmin) and maximum density (Dmax) of the tone again the reversed image obtained by the treatment at 25° C. The LDA type coloring materials provided higher Dmax than R1 and R2.

TABLE 3

| No. | LDA Compound No. | Hue | D max | D min |
|---|---|---|---|---|
| 1 | 1 | Yellow | 1.84 | 0.24 |
| 2 | 3 | Yellow | 1.88 | 0.23 |
| 3 | 11 | Yellow | 1.85 | 0.21 |
| 4 | 12 | Magenta | 2.04 | 0.22 |
| 5 | 19 | Yellow | 1.95 | 0.22 |
| 6 | 20 | Cyan | 2.17 | 0.23 |
| R1 | Compound A + Compound B | Yellow | 1.6 | 0.23 |
| R2 | Compound C + Compound D | Yellow | 1.5 | 0.22 |

Treatment Solution

| | |
|---|---|
| 1-Phenyl-4-hydroxymethyl-4-methyl-3-pyrazolidone | 8.0 g |
| 5-Methylbenzotriazole | 2.5 g |
| Sodium Carboxymethyl Cellulose | 58 g |
| Potassium Hydroxide | 56 g |
| Benzyl Alcohol | 1.5 cc |
| Carbon Black | 150 g |
| Water to make | 1 kg |

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having provided thereon at least one light-sensitive silver halide emulsion layer in combination with an immobile LDA compound represented by the following general formula (I):

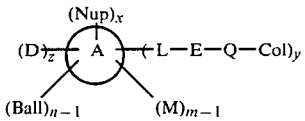

(I)

wherein n, x, y and z each stands for an integer of 1 or 2; m stands for an integer of 1 or more; D stands for a group containing an electron doner or its precursor moiety that forms an electron donor under alkaline conditions; A stands for an organic group linking Nup to -E-Q-Col and D so as to permit an intramolecular redox reaction between the electron donor group and the nucleophilic precursor group and intramolecular nucleophilic displacement between the nucleophilic group and the electrophilic group; Nup stands for a precursor of a nucleophilic group that forms a nucleophilic group upon reduction; E stands for an electrophilic center; Q is a divalent group; Col stands for a group containing a dye or its precusor moiety; Ball stands for a ballast group; L stands for a linking group; and M stands for an optional substituent, said LDA compound being capable of releasing a diffusible dye or its precursor upon redox reaction.

2. A photographic light-sensitive material as claimed in claim 1, wherein the precursor moiety of electron donor is derived from a compound represented by the following general formula (D-I):

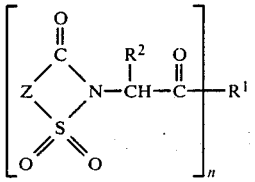

(D-I)

wherein Z stands for an atomic group necessary for the formation of a monocyclic, bicyclic or tricyclic ring; n stands for an integer of 1 or 2; $R^1$ stands for a monovalent aromatic ring when n is 1 and stands for a divalent aromatic ring when n is 2; and $R^2$ stands for an optional substituent.

3. A photographic light-sensitive material as claimed in claim 2, wherein the precursor moiety of electron donor has the structure of the following general formula (D-Ia):

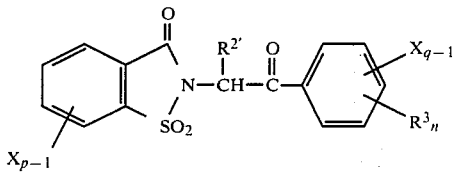

(D-Ia)

wherein $R^{2'}$ stands for a hydrogen atom, a $C_{1-30}$ alkyl group or a $c_{6-30}$ aryl group; X stands for a divalent connecting group; p and q each stands for an integer of 1 or 2, with proviso that when p is 2, then q is 1, whereas when p is 1, then q is 2; $R^3$ stands for an optional substituent; and n stands for an integer of 1 to 3.

4. A photographic light-sensitive material as claimed in claim 1, wherein the precuso moiety of electron donor is derived from a compound represented by the following general formula (D-II):

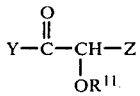

(D-II)

wherein $R^{11}$ stands for a group unstable against alkalis; Y stands for an aliphatic or aromatic group; and Z stands for an electron attractive group.

5. A photographic light-sensitive material as claimed in claim 4, wherein the precursor moiety of electron donor is represented by the following general formula (D-IIa):

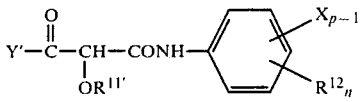

(D-IIa)

wherein $R^{11'}$ stands for group unstable against alkalis; X is a divalent linking group; Y' stands for a $C_{1-30}$ alkyl group or a phenyl group of the formula:

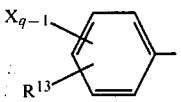

in which X is defined as above; p and q each stands for an integer of 1 or 2, with proviso that when p is 2, then q is 1, whereas when p is 1, then q is 2; $R^{12}$ and $R^{13}$ each stands for an optional substituent, $R^{12}$ and $R^{13}$ being either the same or different from each other; and n stands for an integer of 1 to 3.

6. A photographic light-sensitive material as claimed in claim 1, wherein the precursor moiety of electron donor is derived from a compound represented by the following general formula (D-III):

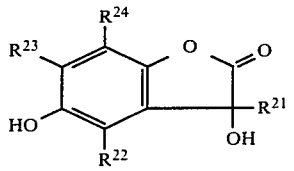

(D-III)

wherein $R^{21}$ stands for an aromatic or heterocyclic group; and $R^{22}$, $R^{23}$ and $R^{24}$, which may be the same or different, each stands for a hydrogen atom, a $C_{1-30}$ alkyl group, a $C_{1-30}$ alkyloxy group, an aryl group or an alkylthio group.

7. A photographic light-sensitive material as claimed in claim 6, wherein the precursor moiety of electron donor is represented by the following general formula (D-IIIa):

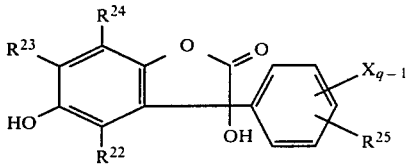

(D-IIIa)

wherein $R^{22}$, $R^{23}$ and $R^{24}$ are as defined above in claim 6, with the proviso that any one of $R^{22}$, $R^{23}$ and $R^{24}$ can be $-(R^{26})_{m-1}X$ when $q=1$, in which m stands for an integer of 1 or 2, and $R^{26}$ stands for a $C_{1-17}$ alkylene or a phenylene group; X stands for a divalent connecting group; and $R^{25}$ stands for an optional substituent.

8. A photographic light-sensitive material as claimed in claim 1, wherein said LDA compound is a compound represented by the following general formula (II):

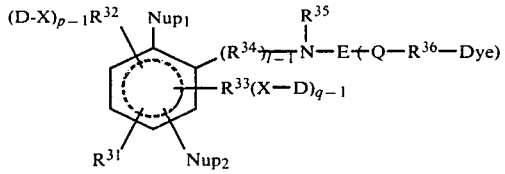

(II)

wherein $Nup_1$ and $Nup_2$, which may be the same or different, each stands for a precursor of hydroxyl group as a nucleophilic group; E stands for an electrophilic center; Q stands for a divalent group connecting E and $R^{36}$; $R^{34}$ stands for a divalent linking group; l stands for an integer of 1 or 2; $R^{36}$ stands for an aromatic group having at least 5 carbon atoms or a $C_{1-6}$ aliphatic hydrocarbon group; $R^{35}$ stands for an alkyl group having 1 to about 40 carbon atoms or an aryl group having 6 to about 40 carbon atoms; p and q each stands for an integer of 1 or 2, with proviso that the both do not stand for 1 at the same time and that when p or q is 2, then $R^{32}$ or $R^{33}$, which may be the same or different, stands for any group selected from alkylene or substituted alkylene group having 1 to about 20 carbon atoms or phenylene or substituted phenylene group having 6 to about 20 carbon atoms, whereas when p or q is 1, $R^{32}$ or $R^{33}$ stands for a hydrogen or halogen atom, an unsubstituted or substituted alkyl, alkoxy or alkylthio group having 1 to about 20 carbon atoms, or a phenyl or substituted phenyl group having up to about 20 carbon atoms; Dye stands for a dye or its precursor moiety; -X-D stands for a precursor moiety of electron donor; and $R^{31}$ stands for a one-atom-substituent or a multi-atom-substituent selected from a group consisting of an alkyl, alkoxy or alkylthio group having 1 to about 40 carbon atoms and an aryl group having 6 to about 40 carbon atoms, or the following group:

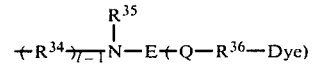

wherein $R^{34}$, $R^{35}$, $R^{36}$, l, E, Q, and Dye are each the same as defined above, and may form a ring together with $R^{32}$.

9. A photographic light-sensitive material as claimed in claim 1, wherein the organic group represented by A is a group derived from an aromatic hydrocarbon or heterocyclic compound, or another organic group having a conjugated double bond.

10. A photographic light-sensitive material as claimed in claim 1, wherein the nucleophilic precursor is a nitroso group, a nitro group, an oxo group, an imino group, an alkylimino group, or a sulfonimino group.

11. A photographic light-sensitive material as claimed in claim 1, wherein the electrophilic center represented by E is a thiocarbonyl group or a sulfonyl group.

12. A photographic light-sensitive material as claimed in claim 1, wherein the ballast group represented by Ball is a photographically inert group which is able to immobilize the LDA compound.

13. A photographic light-sensitive material as claimed in claim 1, wherein the electron donor represented by D is a group derived from hydroquinone and derivatives thereof, aminophenol and derivatives thereof, ascorbic acids, or benzisoxazolones.

14. A photographic light-sensitive material as claimed in claim 1, wherein the LDA compound is used in an amount of $1\times10^{-4}$ to $10^{-2}$ mole/$m^2$.

15. A photographic light-sensitive material as claimed in claim 1, wherein the LDA compound is LDA-1, 3, 5, 10, 11, 12, 19, 20, 28 or 32 as illustrated in the specification.

16. A photographic light-sensitive material as claimed in claim 1, useful for color diffusion transfer photography.

17. A photographic light-sensitive material as claimed in claim 1, useful for heat development-type color photography.

* * * * *